US007295223B2

(12) United States Patent
Jung

(10) Patent No.: US 7,295,223 B2
(45) Date of Patent: Nov. 13, 2007

(54) METHOD AND APPARATUS FOR ADJUSTING AN IMAGE ALIGNMENT FOR AN IMAGE FORMING APPARATUS

(75) Inventor: Young-do Jung, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 275 days.

(21) Appl. No.: 11/189,002

(22) Filed: Jul. 26, 2005

(65) Prior Publication Data

US 2006/0023057 A1 Feb. 2, 2006

(30) Foreign Application Priority Data

Jul. 30, 2004 (KR) ..... 10-2004-0060112
Sep. 4, 2004 (KR) ..... 10-2004-0070618

(51) Int. Cl.
*B41J 2/315* (2006.01)

(52) U.S. Cl. ..... 347/177

(58) Field of Classification Search ..... 347/177, 347/171, 172, 174, 175, 176, 190, 197, 198, 347/104

See application file for complete search history.

(56) References Cited

U.S. PATENT DOCUMENTS 5,101,222 A 3/1992 Hakkaku
6,373,042 B1 4/2002 Kretschmann et al.
6,601,952 B2 * 8/2003 Sugioka et al. ..... 347/104
7,027,076 B2 * 4/2006 Ruiz et al. ..... 347/190
2005/0140770 A1 * 6/2005 Kang et al. ..... 347/198
2005/0162503 A1 * 7/2005 Jung et al. ..... 347/175

FOREIGN PATENT DOCUMENTS

JP 05-112052 5/1993
JP 06-091907 4/1994
JP 10-278322 10/1998
JP 11-188937 7/1999

(Continued)

OTHER PUBLICATIONS

Office Action from Korean Intellectual Property Office, dated Jan. 25, 2006.

*Primary Examiner*—K. Feggins
(74) *Attorney, Agent, or Firm*—Roylance, Abrams, Berdo & Goodman, L.L.P.

(57) ABSTRACT

A method and apparatus for adjusting an image alignment of an image forming apparatus that uses a thermal print head for applying heat to first and second sides of a medium for printing are provided. In the apparatus and method, a first printed area on the first side of the medium is detected by a sensor after printing a first pattern on a first setup print zone of the first side of the medium, a first-to-second printed area on the medium is detected by the sensor after printing a second pattern on a second setup print zone of the second side of the medium, a position deviation between the printed areas of the first and second sides is calculated using the first setup print zone, the second setup print zone, the detected first printed area, and the detected first-to-second printed area, and the setup print zones of the first and second sides of the medium is adjusted using the calculated position deviation.

53 Claims, 24 Drawing Sheets

FOREIGN PATENT DOCUMENTS

| | | |
|---|---|---|
| JP | 2001-199055 | 7/2001 |
| JP | 2001-310503 | 11/2001 |
| JP | 2001-331073 | 11/2001 |
| JP | 2002-036612 | 2/2002 |
| JP | 2002-178505 | 6/2002 |
| JP | 2003-302887 | 10/2003 |

* cited by examiner

METHOD AND APPARATUS FOR ADJUSTING AN IMAGE ALIGNMENT FOR AN IMAGE FORMING APPARATUS

CROSS-REFERENCE TO RELATED PATENT APPLICATION

This application claims the benefit under 35 U.S.C. 119(a) of Korean Patent Application No. 10-2004-0060112, filed on Jul. 30, 2004 and 10-2004-0070618, filed on Sep. 4, 2004, respectively, in the Korean Intellectual Property Office, the entire contents of which are incorporated hereby by reference.

BACKGROUND OF THE INVENTION

1. Field of the Invention

The present invention relates to an image forming apparatus using a thermal print head. More particularly, the present invention relates to a method and device for adjusting an image alignment of an image forming apparatus that uses one thermal print head for applying heat to first and second sides of a medium in order to print an image.

2. Description of the Related Art

Thermal printers use a thermal print head to apply heat to an ink ribbon contacting a medium to transfer the ink of the ribbon to the medium, or apply heat to a medium coated with ink capable of presenting color when heat is applied.

FIG. 1 is a view of a heat-sensitive medium according to the related art.

Referring to FIG. 1, a heat-sensitive medium includes a base sheet 11, a first side 10*a*, a second side 10*b*, and a reflective layer 13. Ink layers of different colors are formed on first and second sides 10*a* and 10*b*. For example, yellow and magenta layers may be sequentially formed on the first side 10*a*, and a cyan layer may be formed on the second side 10*b*. The base sheet 11 may comprise a transparent material. The reflective layer 13 reflects light, such that a color image can be seen from the first side 10*a*.

FIG. 2 is a schematic view showing a construction of an image forming apparatus using a thermal print head according to the related art.

Referring to FIG. 2, an image forming apparatus includes a medium 200, a driving roller 210, a driven roller 220, a platen roller 230, and a thermal print head 240.

A motor (not shown) rotates the driving roller 210 to convey the medium 200, which is interposed between the driving roller 210 and the driven roller 220.

The thermal print head 240 applies heat to the conveying medium 200, for printing yellow, magenta and cyan data. The platen roller 230 is faced with the thermal print head 240 with the medium 200 interposed there between. The platen roller 230, as it rotates when the medium is conveyed, supports the medium 200 that receives heat from the thermal print head 240 to provide color printing.

In order to print the yellow, magenta, and cyan data with one thermal print head 240, the thermal print head 240 must apply the heat to the first and second sides 10*a* and 10*b* of the medium 200.

As described above, when one thermal print head is used to apply heat to the first and second sides of the medium, a mechanical deviation or a medium conveying path difference is generated, such that the printed areas on the first side and second side of the medium are not aligned with each other and thereby the required colors are not accurately placed in the printed image.

Therefore, a need exists for aligning both sides of a printed medium such that the colors are accurately placed in the printed image when one thermal print head is used.

SUMMARY OF THE INVENTION

The present invention provides a method and device for adjusting an image alignment of an image forming apparatus, in which a position deviation of printed areas on first and second sides of the medium is calculated by comparing setup print zones of patterns on the first and second sides with printed areas detected by a sensor, and the setup print zones are adjusted with the calculated position deviation, such that the alignment between the printed areas of the first and second sides can be adjusted in an exact and convenient way.

According to an aspect of the present invention, there is provided a method of adjusting an image alignment of an image forming apparatus provided with a thermal print head applying heat to first and second sides of a medium for printing, the method comprising detecting a first printed area on the first side of the medium with a sensor after printing a first pattern on a first setup print zone of the first side of the medium; detecting a first-to-second printed area of the medium with a sensor after printing a second pattern on a second setup print zone of the second side of the medium; calculating a position deviation between the printed areas of the first side and the second side, by using the first setup print zone, the second setup print zone, the detected first printed area, and the detected first-to-second printed area; and adjusting print positions of the first or the second sides of the medium by using the calculated position deviation.

Each detecting operation may comprise receiving image data of the medium from the sensor; determining a variation in the image data; and detecting the printed area by using the determined variation in the image data.

The variation in the image data may be a rising edge or a falling edge of the image data.

The adjusting of print positions may be performed by adjusting a first heating start point from which the thermal print head starts to apply heat to the first side of the medium or adjusting a second heating start point from which the thermal print head starts to apply heat to the second side of the medium.

According to another aspect of the present invention, there is provided a method of adjusting an image alignment of an image forming apparatus provided with a thermal print head applying heat to first and second sides of a medium for printing. The method comprising detecting a first printed area on the first side of the medium with a sensor after printing a first pattern on a first setup print zone of the first side of the medium; detecting a first-to-second printed area on the medium with a sensor after printing a second pattern on a second setup print zone of the second side of the medium, the second setup print zone being overlapped with the first setup print zone on the first side of the medium; calculating a position deviation between the printed areas of the first side and the second side by using the first setup print zone, the second setup print zone, the detected first printed area, and the detected first-to-second printed area; and adjusting print positions of the first or the second sides of the medium by using the calculated position deviation.

The thermal print head may be rotated to face the first side and the second side of the medium.

Each of the patterns may have a polygonal shape.

Each detecting operation comprises receiving image data of the medium from the sensor; determining a variation in the image data; and detecting the printed area with the determined variation of the image data. The variation in the image data may be a rising edge or a falling edge of the image data.

The calculating of the position deviation may comprise calculating a setup-zone-difference value between a center of the first setup print zone and a center of the second setup print zone; calculating a printed-area-difference value between a center of the detected first printed area and a center of the detected first-to-second printed area; calculating the position deviation by using the calculated setup-zone-difference value and the printed-area-difference value; calculating an edge-to-area distance difference value between a first edge-to-area distance and a second edge-to-area distance, wherein the first edge-to-area distance is a distance from an edge of the medium to the first printed area, the second edge-to-area distance is a distance from the edge of the medium to the first-to-second printed area, and the edge and the printed areas are detected in the detecting operations; and adjusting the position deviation by using the edge-to-area distance difference value.

The adjusting of print positions may be performed by adjusting a first heating start point from which the thermal print head starts to apply heat to the first side of the medium or adjusting a second heating start point from which the thermal print head starts to apply heat to the second side of the medium.

According to another aspect of the present invention, there is provide a device for adjusting an image alignment of an image forming apparatus provided with a thermal print head applying heat to first and second sides of a medium for printing. The device comprising a pattern printer for printing a first pattern on a first setup print zone of the first side of the medium and a second pattern on a second setup print zone of the second side of the medium; an area detector for detecting printed areas of the medium; a deviation calculator for comparing the setup print zones with the printed areas detected by the area detector to calculate a position deviation between the printed areas of the first and the second sides of the medium; and an adjustor for adjusting print positions of the first or the second sides of the medium by using the calculated position deviation.

The pattern printer may comprise a conveyer for conveying the medium; a thermal print head for applying heat to the first side and the second side of the medium, for a printing operation; a print controller for controlling the conveyer and the thermal print head to print the first pattern on the first setup print zone of the first side of the medium and the second pattern on the second setup print zone of the second side of the medium. The pattern printer may further comprise a head position adjustor for rotating the thermal print head to face the first side and the second side of the medium. Each of the patterns may have a polygonal shape.

The area detector comprises a sensor for sensing an image from the medium and outputting corresponding image data; and a distance detector for determining variations in the image data in order to detect a distance between the variations.

The distance detector may determine the variations in the image data and detect the distance between the variations by using an encoder.

The variations in the image data may be rising edges or falling edges of the image data.

The deviation calculator may comprise a memory for storing the setup print zones, in the detected printed areas; a memory controller for controlling the memory to store the first setup print zone, the second setup print zone, a first printed area detected by the area detector after the first pattern is printed on the medium, and a first-to-second printed area detected by the area detector after the first and the second patterns are printed on the medium; a difference value calculator for calculating a setup-zone-difference value between a center of the first setup print zone and a center of the second setup print zone, and a printed-area-difference value between a center of the detected first printed area and a center of the detected first-to-second printed area; and a deviation output unit for calculating the position deviation by using the calculated setup-zone-difference value and the printed-area-difference value.

The deviation calculator may further comprise a compensation value calculator for calculating an edge-to-area distance difference value between a first area- to-edge distance and a second edge-to-area distance, wherein the first edge-to-area distance is a distance from an edge of the medium to the first printed area, and the second edge-to-area distance is a distance from the edge of the medium to the first-to-second printed area; and a deviation adjustor for adjusting the position deviation calculated by the deviation output unit, by using the calculated edge-to-area distance difference value.

The adjustor may use the calculated position deviation to adjust a first heating start point from which the thermal print head starts to apply heat to the first side of the medium or adjust a second heating start point from which the thermal print head starts to apply heat to the second side of the medium.

According to another aspect of the present invention, there is provided a method of adjusting an image alignment of an image forming apparatus in which a thermal print head applies heat to a first side of a medium after loading the medium along a first conveying passage and applies heat to a second side of the medium after loading the medium along a second conveying passage. The method comprising detecting the medium with a sensor when the medium is loaded along the first conveying passage and storing a first analog signal output from the sensor in a recording medium; detecting the medium with the sensor when the medium is loaded along the second conveying passage and storing a second analog signal output from the sensor in the recording medium; calculating a position deviation between printed areas of the first side and the second side of the medium, by using the first and second analog signals stored in the recording medium; and adjusting print positions of the first or the second sides of the medium by using the calculated position deviation.

The thermal print head may be capable of rotating to be faced with the first side and the second side of the medium. Each of the first and second analog signals may be output by sensing a predetermined portion of the medium, the predetermined portion comprising an edge of the medium.

The calculating of the position deviation may comprise calculating an output ratio of the first analog signal to the second analog signal; and calculating the position deviation with the calculated output ratio.

The calculating of the position deviation with the calculated output ratio may comprise calculating an imaginary reference value by multiplying the calculated output ratio by a digital reference value of the sensor; detecting a position having the imaginary reference value in the stored first analog signal; and calculating a position deviation between the detected position and a position having the digital reference value in the stored second analog signal.

The calculating of the position deviation with the calculated output ratio may comprise obtaining an imaginary reference value by multiplying the calculated output ratio by a digital reference value of the sensor; detecting a position having the imaginary reference value in the stored second analog signal; and calculating a position deviation between the detected position and a position having the digital reference value in the stored first analog signal.

The adjusting of print position may be performed by adjusting a first heating start point from which the thermal print head starts to apply heat to the first side of the medium or adjusting a second heating start point from which the thermal print head starts to apply heat to the second side of the medium.

According to another aspect of the present invention, there is provided a method of adjusting an image alignment of an image forming apparatus provided with a thermal print head applying heat to first and second sides of a medium for printing. The method comprising printing first and second patterns on first and second setup print zones of the first side of the medium, respectively; after printing a third pattern on a third setup print zone of the second side of the medium, detecting printed areas of the first to third patterns with a sensor; calculating a deviation between the printed positions of the first side and the second side, by using the detected printed areas; and adjusting print positions of the first or second sides of the medium by using the calculated deviation.

The first, second, and third setup print zones may be spaced the same distance from each other.

The detecting of the printed areas may comprise receiving image data of the medium from the sensor; checking variations in the image data; and detecting the printed areas on the medium with the checked variations of the image data.

The variations in the image data may be rising edges or falling edges of the image data.

The calculating of the position deviation may comprise calculating a first-to-second distance value between centers of the detected first and second patterns; calculating a second-to-third distance value between centers of the detected second and third patterns; and calculating a center distance difference value between the first-to-second difference value and the second-to-third difference value.

According to another aspect of the present invention, there is provided a computer-readable recording medium having a computer-readable program for executing the alignment adjusting methods.

According to another aspect of the present invention, there is provided a device for adjusting an image alignment of an image forming apparatus in which a thermal print head applies heat to a first side of a medium after loading the medium along a first conveying passage and applies heat to a second side of the medium after loading the medium along a second conveying passage to print on the first and second sides of the medium. The device comprising a conveyer for loading the medium; an analog signal generator for sensing the medium when the medium is conveyed along the first and second conveying passages to generate corresponding first and second analog signals; a deviation calculator for calculating a deviation between printed positions of the first and second sides of the medium by using the first and second analog signals; and an adjustor adjusting print positions of the first or the second sides of the medium by using the calculated position deviation.

The thermal print head may be rotated to face the first side and the second side of the medium. Each of the first and second analog signals may be output by sensing a predetermined portion of the medium, the predetermined portion comprising an edge of the medium.

The analog signal generator may comprise a sensor for sensing the medium when the medium is loading along the first and second conveying passage to generate the corresponding first and second analog signals; a recording medium for storing the first and second analog signals; and a controller for controlling the storing of the first and second analog signals in the recording medium.

The deviation calculator may comprise a ratio calculator for calculating an output ratio of the first analog signal to the second analog signal; and a distance calculator for calculating the position deviation with the calculated output ratio.

The distance calculator may comprise a reference calculator for calculating an imaginary reference value by multiplying the calculated output ratio by a digital reference value of the sensor; a position detector for detecting a position having the imaginary reference value in the stored first analog signal; and a position distance calculator for calculating the position deviation by using the detected position and a position having the digital reference value in the stored second analog signal.

The distance calculator may comprise a reference calculator for calculating an imaginary reference value by multiplying the calculated output ratio by a digital reference value of the sensor; a position detector for detecting a position having the imaginary reference value in the stored second analog signal; and a position distance calculator for calculating the position deviation by using the detected position and a position having the digital reference value in the stored first analog signal.

According to another aspect of the present invention, there is provided a device for adjusting an image alignment of an image forming apparatus provided with a thermal print head applying heat to first and second sides of a medium for printing. The device comprising: a pattern printer printing first and second patterns on the first side of the medium and a third pattern on the second side of the medium; an area detector for detecting printed areas of the medium; a deviation calculator for comparing the printed areas detected by the area detector to calculate a deviation between the printed positions of the first and the second sides of the medium; and an adjustor for adjusting print positions of the first or the second sides of the medium by using the calculated deviation.

The first, second, and third patterns may be spaced the same distance from each other. The pattern printer may comprise a conveyer for conveying the medium; a thermal print head for applying heat to the first side and the second side of the medium, for a printing operation; a print controller for controlling the conveyer and the thermal print head to print the first and second patterns on first and second setup print zones of the first side of the medium and the third pattern on a third setup print zone of the second side of the medium.

The alignment adjusting device may further comprise a head position adjustor for rotating the thermal print head to face with the first side and the second side of the medium.

The area detector may comprise a sensor for sensing an image on the medium and outputting corresponding image data; and a distance detector for determining variations in the image data to detect a distance between the variations. The variations in the image data may be rising edges or falling edges of the image data.

The deviation calculator may comprise a memory for storing the detected printed areas; a controller for storing on the recording medium printed areas detected by the area detector after the first, second, and third patterns are printed on the medium; a difference value calculator for calculating a first-to-second distance value between centers of the detected first and second patterns and a second-to-third distance value between centers of the detected second and third patterns; and a deviation output unit for outputting a difference value between the first-to-second distance value and the second-to-third distance value.

According to another aspect of the present invention, there is provided a computer-readable recording medium having a computer-readable program for executing the alignment adjusting methods.

BRIEF DESCRIPTION OF THE DRAWINGS

The above and other features and advantages of the present invention will become more apparent by describing in detail exemplary embodiments thereof with reference to the attached drawings in which.

Throughout the drawings, the same or similar elements, features and structures are represented by the same reference numerals.

DETAILED DESCRIPTION OF EXEMPLARY EMBODIMENTS

The present invention will now be described more fully with reference to the accompanying drawings.

Figure 1:
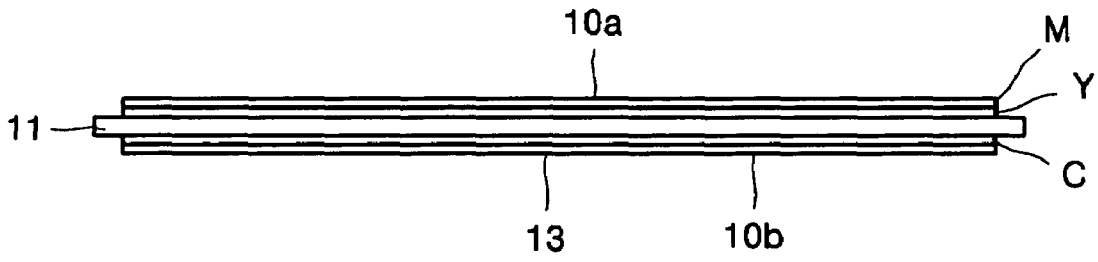
FIG. 1 (PRIOR ART)
FIG. 1 is a view of a heat-sensitive medium according to the related art.
Figure 2:
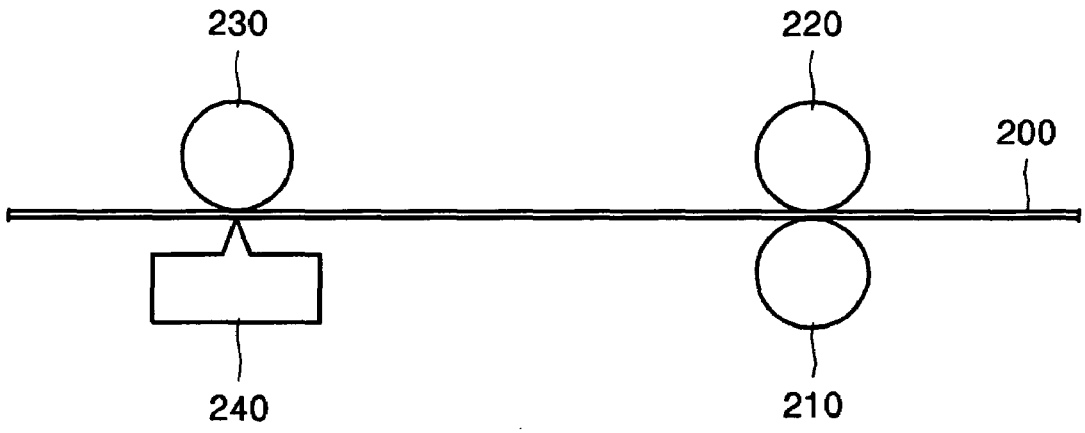
FIG. 2 (PRIOR ART)
FIG. 2 is a schematic view showing a construction of an image forming apparatus using a conventional thermal print head according to the related art.
Figure 3:
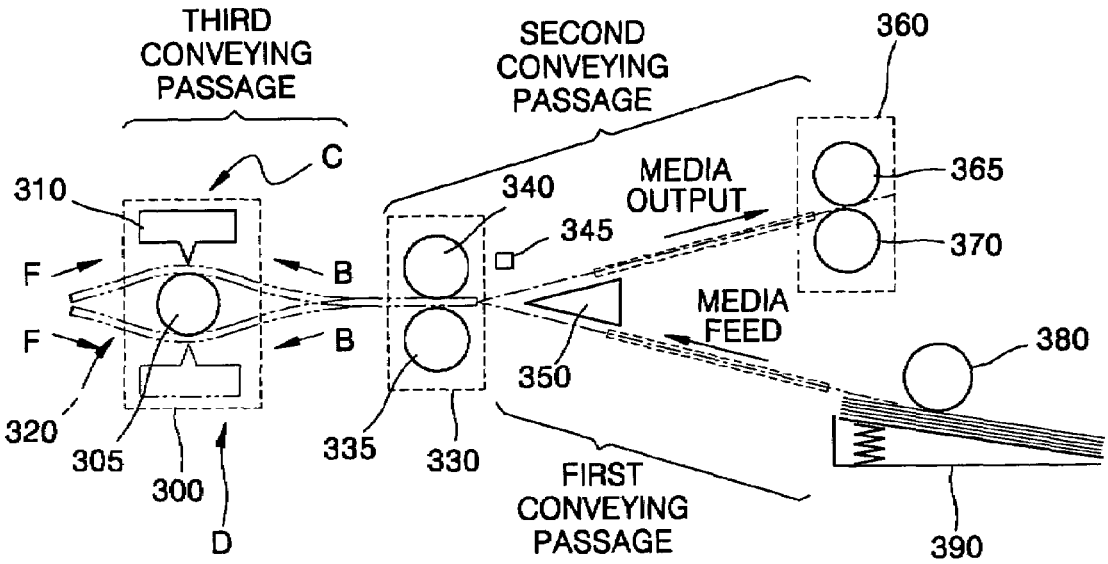
FIG. 3 is a schematic view showing a construction of an image forming apparatus using a thermal print head according to an embodiment of the present invention.

FIG. 3 is a schematic view showing a construction of an image forming apparatus using a thermal print head according to an embodiment of the present invention.

Referring to FIG. 3, an image forming apparatus includes a platen roller 305, a thermal print head 310, a driving roller 335, a driven roller 340, an edge-detecting sensor 345, a medium guide 350, an output driven roller 365, an output roller 370, a pick-up roller 380, and a medium cassette 390.

The image forming apparatus that uses one thermal print head 310 comprises at least three conveying passages: first, second, and third conveying passages in order to convey a medium 320. The pick-up roller 380 picks up the medium 320 from the medium cassette 390 and feeds the medium 320 to the first conveying passage.

Along the second conveying passage, the medium 320 is conveyed in a back or reverse direction (B) for printing and conveyed in a printing direction forward (F). While the medium 320 is conveyed in the printing direction (F), the thermal print head 310 applies heat to the medium 320 for printing.

Along the third conveying passage, the medium 320 is conveyed back to the second conveying passage in the back direction (B) in order to be printed on its second side after being printed on its first side by the heat of the thermal print head 310. Also, along the third conveying passage, the medium 320 is output in the same direction of the printing direction (F) after being printed on the first side and the second side.

The medium guide 350 may be provided between the first and second conveying passages to guide the medium 320 from the first conveying passage to the second conveying passage and from the second conveying passage to the third conveying passage.

At the second conveying passage, a printing unit 300 prints an image on the medium 320. Though the image printing operation is performed once on each side of the medium 320 in this embodiment two times, the image printing operation can be performed more than two times.

The position of the thermal print head 310 must be determined before printing an image on the first or second side of the medium 320. For example, the thermal print head 310 is placed at a location (D) when an image is printed on the first side of the medium 320 and the thermal print head 310 is placed at a location (C) when another image is printed on the second side of the medium 320. The thermal print head 310 and the platen roller 305 may be rotated about the rotating center of the platen roller 305 to shift the position of the thermal print head 310. During the position shifting of the thermal print head 310, there should be no interference between the thermal print head 310 and the medium 320. For example, the position shifting can be performed before the medium 320 is conveyed from the first conveying passage, or before the medium 320 returns to the second conveying passage from the third conveying passage.

When the medium 320, of which the first side is printed, is conveyed in the back direction (B) from the third conveying passage to the second conveying passage, the position shifted thermal print head 310 prints an image onto the second side of the medium 320. During the image printing operation, a conveyer 330 gradually conveys the medium 320 in the printing direction (F), and then conveys the medium 320 to a discharging part 360 after completing the image printing operation onto the second side of the medium 320.

The edge-detecting sensor 345 detects an edge of the medium 320 when the conveyer 330 conveys the medium 302. The edge-detecting sensor 345 may be an optical sensor.

Figure 4:
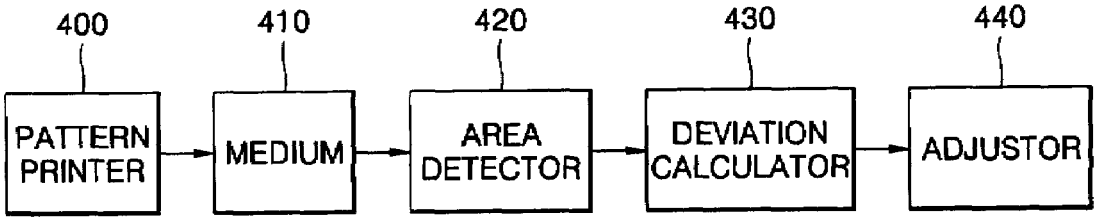
FIG. 4 is a block diagram showing a construction of an alignment adjustment device according to an embodiment of the present invention.
Figure 11:
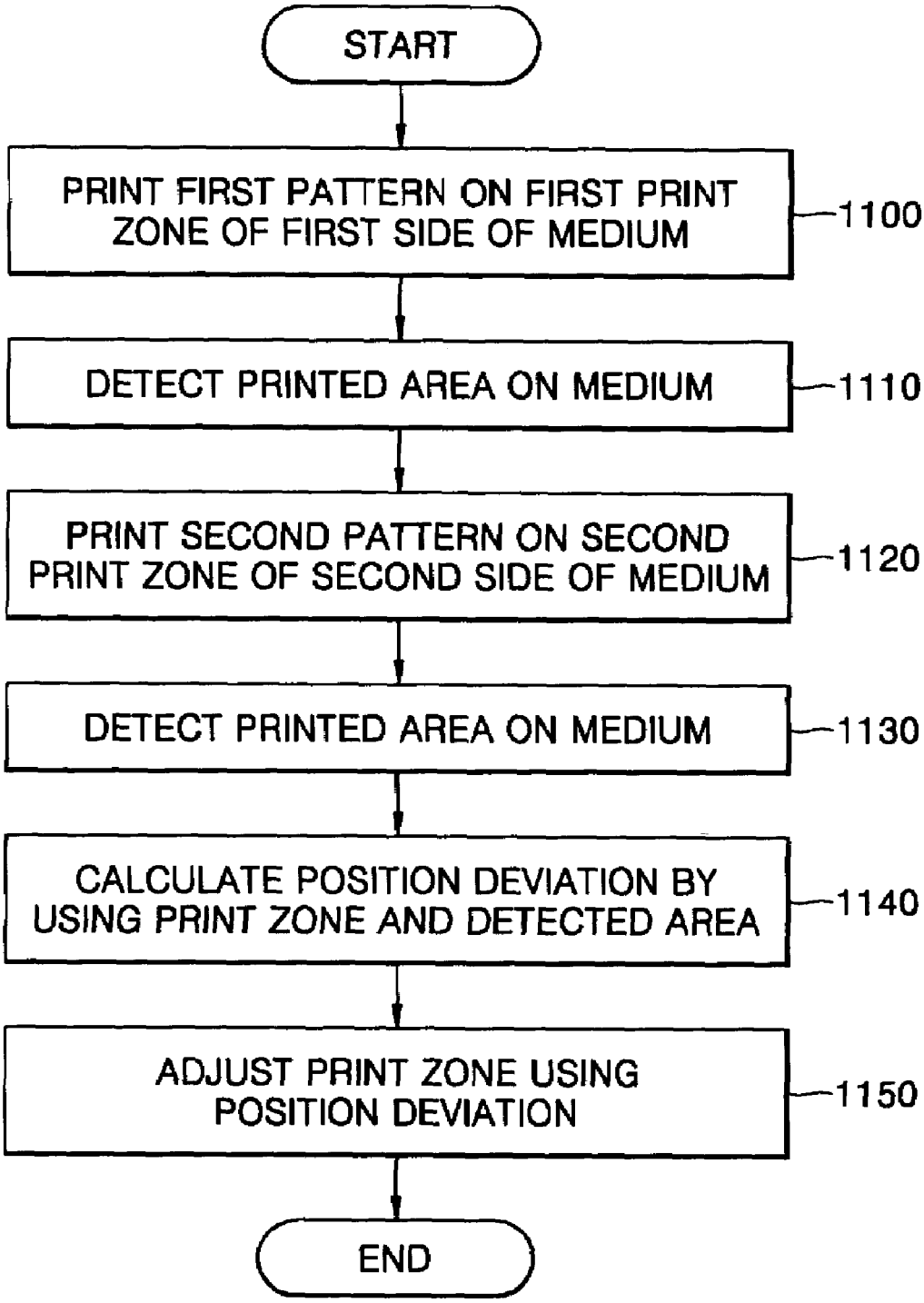
FIG. 11 is a flow chart showing a method of adjusting an image alignment according to an embodiment of the present invention.

FIG. 4 is a block diagram showing a construction of an alignment adjustment device according to an embodiment of the present invention, and FIG. 11 is a flow chart showing an embodiment of a method of adjusting an image alignment.

Referring to FIGS. 4 and 11, an alignment adjustment device comprises a pattern printer 400, a medium 410, an area detector 420, a deviation calculator 430, and an adjustor 440. An operation of the alignment adjusting device will be now described with reference to FIG. 11.

In operation 1100, the pattern printer 400 prints a first pattern on a first setup print zone of a first side of the medium 410. In operation 1110, the area detector 420 detects a printed area (first printed area) of the first pattern on the medium with a sensor.

In operation 1120, the pattern printer 400 prints a second pattern on a second setup print zone of a second side of the medium 410. In operation 1130, the area detector 420 detects printed areas (first-to-second printed area) of the first and second patterns on the medium 410. The first and second setup print zones may be rectangular and have portions overlapping each other to check a position deviation with the naked eye.

The deviation calculator 430 calculates the position deviation of the first and second patterns by comparing the detected printed areas in operations 1110 and 1130 with the setup print zones.

In operation 1150, the adjustor 440 adjusts the first and second setup print zones of the first and second sides of the medium 410 according to the calculated position deviation. For example, when the printed first pattern precedes the printed second pattern by 0.1 mm, a print starting point on the first side of the medium 410 is adjusted by 0.1 mm in a back direction, or a print staring point on the second side of the medium 410 is adjusted by 0.1 mm in a forward direction.

Figure 5:
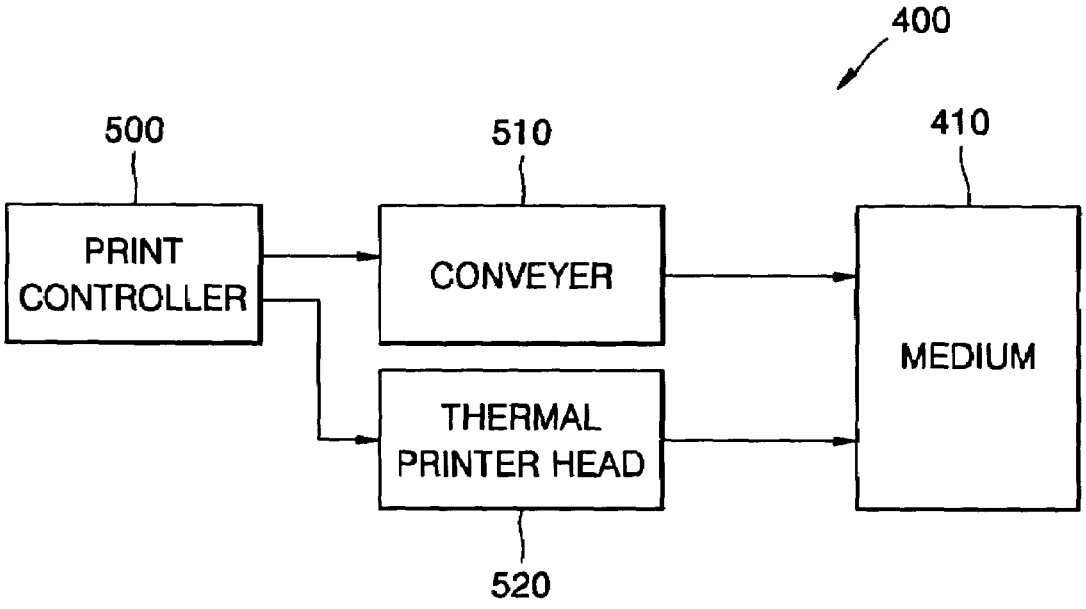
FIG. 5 is a detailed block diagram showing an embodiment of a pattern printer depicted in FIG. 4.
Figure 12:
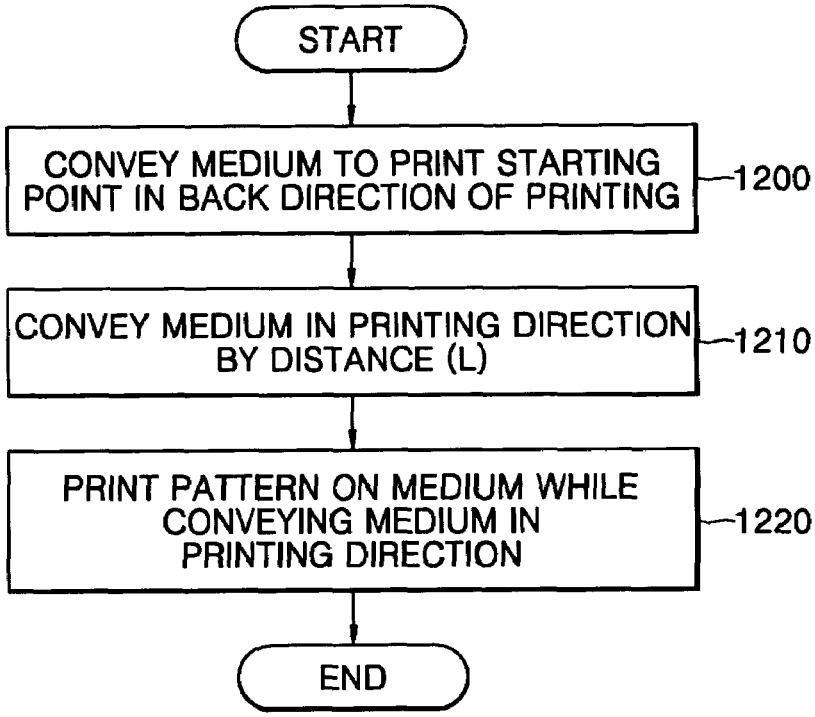
FIG. 12 is a flow chart showing an embodiment of a pattern printing operation depicted in FIG. 11.

FIG. 5 is a detailed block diagram showing an embodiment of a pattern printer depicted in FIG. 4, and FIG. 12 is a flow chart showing an embodiment of a method of printing a pattern on a medium according to an embodiment of the present invention.

Referring to FIGS. 5 and 12, the pattern printer 400 comprises a print controller 500, a conveyer 510, and a thermal print head 520. An operation of the pattern printer 400 will be now described with reference to FIG. 12.

In operation 1200, the print controller 500 controls the conveyer 510 to convey the medium 410 in the back direction of the printing direction until the medium 410 reaches a print starting point that has been set previously. In order to convey the medium 410 to the start point with the conveyer 510, a senor may be used to detect the edge of the medium 410 when the medium 410 arrives at the starting point.

In operation 1210, the print controller 500 controls the conveyer 510 to convey the medium 410 in the printing direction by a predetermined length (L) from the print starting point. When the medium 410 is conveyed by the length (L), the thermal print head 520 starts to apply heat to the conveying medium 410 to print a pattern on it (operation 1220).

Figure 6:
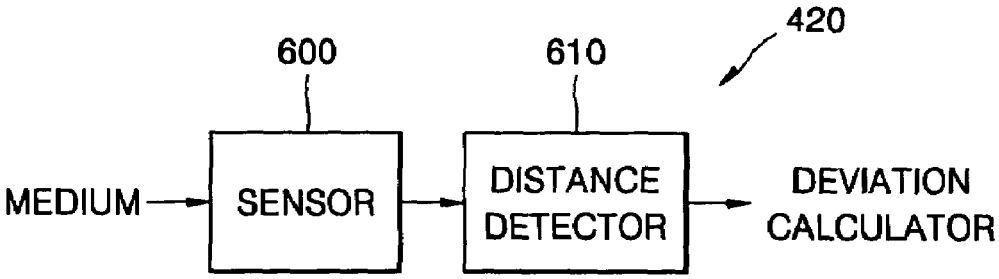
FIG. 6 is a block diagram showing an embodiment of an area detector depicted in FIG. 4.
Figure 13:
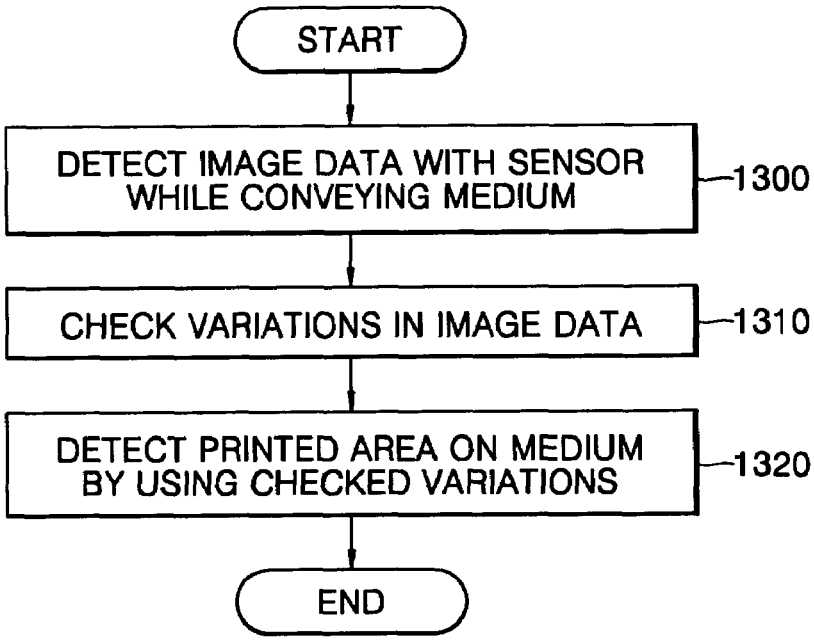
FIG. 13 is a flow chart showing an embodiment of a printed area detecting operation depicted in FIG. 11.

FIG. 6 is a block diagram showing an embodiment of an area detector depicted in FIG. 4, FIG. 13 is a flow chart showing an embodiment of a printed area detecting operation depicted in FIG. 11.

Referring to FIGS. 6 and 13, the area detector 420 comprises a sensor 600 and a distance detector 610. An operation of the area detector 420 will be now described with reference to FIG. 13.

In operation 1300, when the medium 410 is conveyed to the sensor 600 by the conveyer 510, the sensor 600 senses the pattern printed on the medium 410 and converts it into image data.

In operation 1310, the distance detector 610 receives the image data from the sensor 600 and detects variations in the image data. The distance detector 610 may detect rising and falling edges of the image data.

In operation 1320, the distance detector 610 detects position of printed areas on the medium 410 by calculating the distance between the variations in the image data. An encoder (not shown) may be installed in the driving roller 335, the driven roller 340, or the platen roller 305 to generate an electrical signal in response to the rotation of the roller, and the distance detector 610 may utilize the electrical signal to calculate the traveled distance of the medium 410 between the detected variations in the image data.

Figure 7:
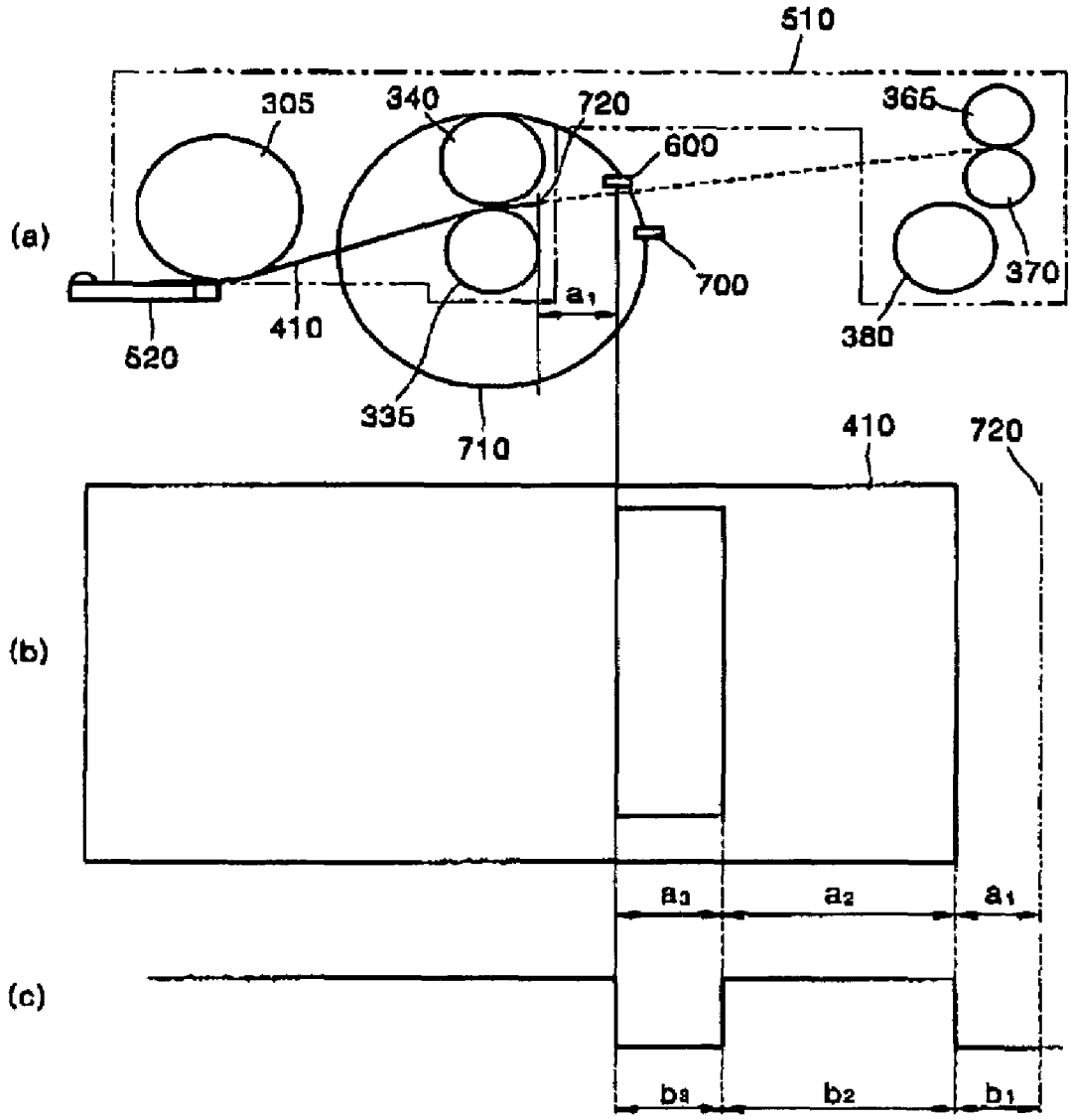
FIGS. 7A, 7B and 7C are views showing an embodiment of a method of detecting a printed area by using a sensor after a pattern is printed on a first side of a medium.

FIGS. 7A, 7B, and 7C are views showing an embodiment of a method of detecting a printed area by using a sensor after a pattern is printed on a first side of a medium. FIG. 7A is a schematic view showing a construction of a printer, FIG. 7B is a view showing an embodiment of a first printed area on a first side of a medium, and FIG. 7C is a view showing image data obtained by sensing a pattern printed on a first printed area of a medium.

Referring to FIG. 7A, the conveyer 510 comprises the platen roller 305, the driving roller 335, the driven roller 340, the output driven roller 365, the output roller 370 and the pickup roller 380. The conveyer 510 conveys the medium 410 to a print starting point 720 until an edge-detecting sensor 700 detects an edge of the medium 410 and then a first pattern is printed on the medium 410 while the conveyer 510 conveys the medium 410 in a printing direction from the print starting point 720. A sensor 600 detects a first printed area of the first pattern after the first side of the medium 410 is printed.

Referring to FIG. 7B, a length (a1) denotes a distance between the print starting point 720 and the edge of the medium 410, a length (a2) denotes a first edge-to-zone distance between the edge and the first setup print zone, and a length (a3) denotes the length of the first setup print zone. The first setup print zone has a rectangular shape.

Referring to FIG. 7C, the distance detector 610 receives image data from the sensor 600 and checks rising and falling edges of the image data in order to calculate a length (b1) between the print starting point 720 and the edge of the medium 410, a first edge-to-area distance (b2) between the edge and the first printed area of the first pattern, and a length (b3) of the first printed area. The lengths (b1), (b2), (b3) may be calculated by using an output signal of an encoder 710 that is installed in the driving roller 335.

Herein, the lengths (a1), (a2), (a3) are used to denote setup print zones, and the lengths (b1), (b2), (b3) are used to denote actually printed areas.

Figure 8:
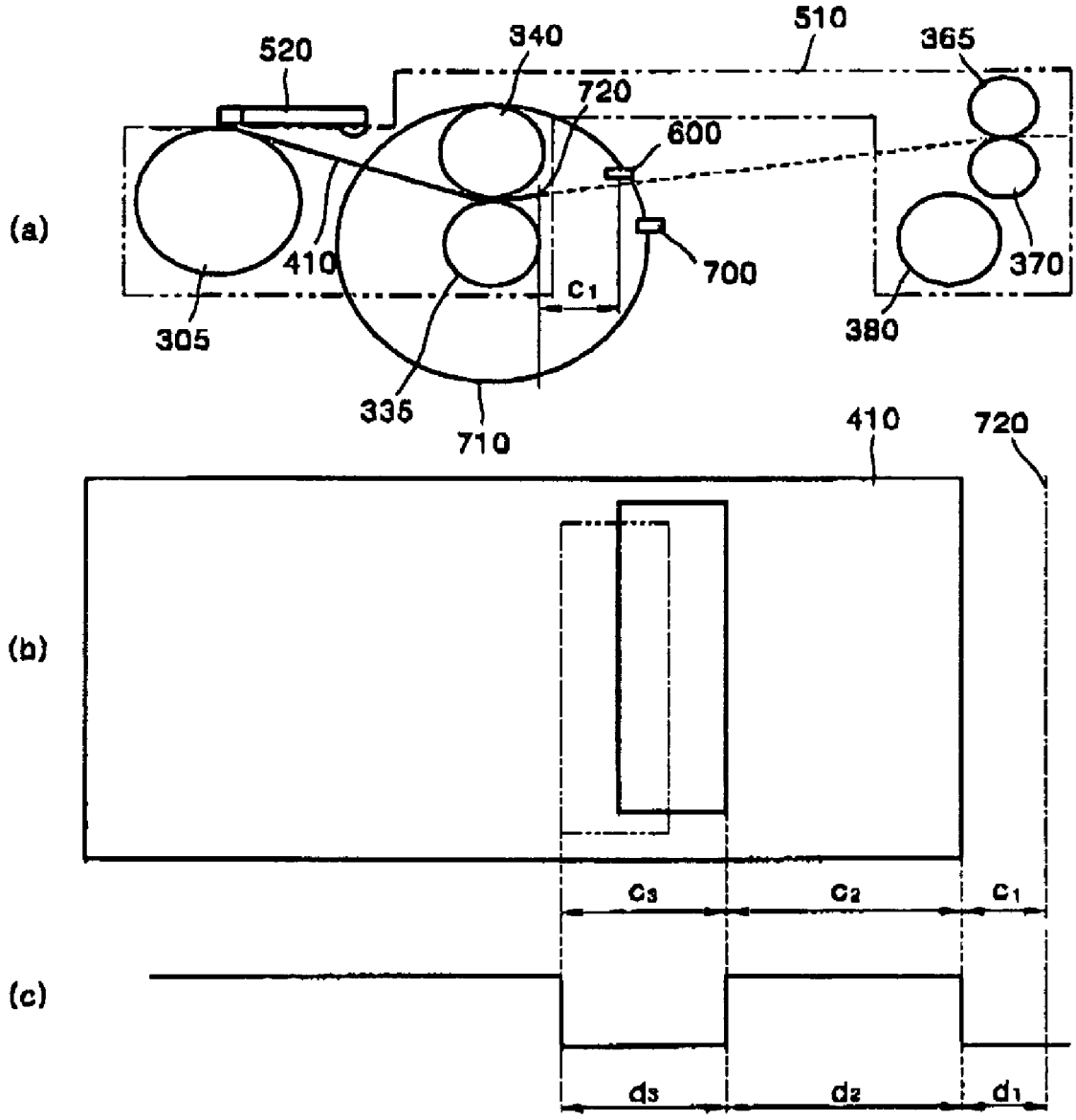
FIGS. 8A, 8B and 8C are views showing an embodiment of a method of detecting printed areas with a sensor after patterns are printed on first and second sides of medium are printed.

FIGS. 8A, 8B, 8C are views showing an embodiment of a method of detecting printed areas with a sensor after first and second patterns are respectively printed on first and second sides of the medium. FIG. 8A is a schematic view showing a construction of a printer, FIG. 8B is a view showing an embodiment of a first-to-second printed area of first and second patterns, and FIG. 8C is a view showing image data obtained by sensing first and second patterns printed on a first-to-second printed area.

Referring to FIG. 8A, the conveyer 510 comprises the platen roller 305, the driving roller 335, the driven roller 340, the output driven roller 365, the output roller 370 and the pickup roller 380. The conveyer 510 conveys the medium 410 again to the print starting point 720 after the first pattern is printed on the first side of the medium. From the starting point 720, the conveyer 510 conveys the medium 410 again in the printing direction, in order to print a second pattern on the second side of the medium 410. The sensor 600 detects a first-to-second printed area of the first and second patterns after the second pattern is printed on the second side of the medium 410.

Referring to FIG. 8B, the first-to-second printed area of the first and second patterns has a length (c3) and it is spaced an edge-to-zone distance (c2) apart from the edge of the medium 410.

Referring to FIG. 8C, the distance detector 610 receives image data from the sensor 600 and detects rising and falling edges of the image data to calculate a length (d1) between the print starting point 720 and the edge of the medium 410, an edge-to-area distance (d2) between the edge and the first-to-second printed area, and a length (d3) of the first-to-second printed area.

Herein, (c1), (c2), (c3) are used to denote setup print zones, and (d1), (d2), (d3) are used to denote actually printed areas.

Figure 9:
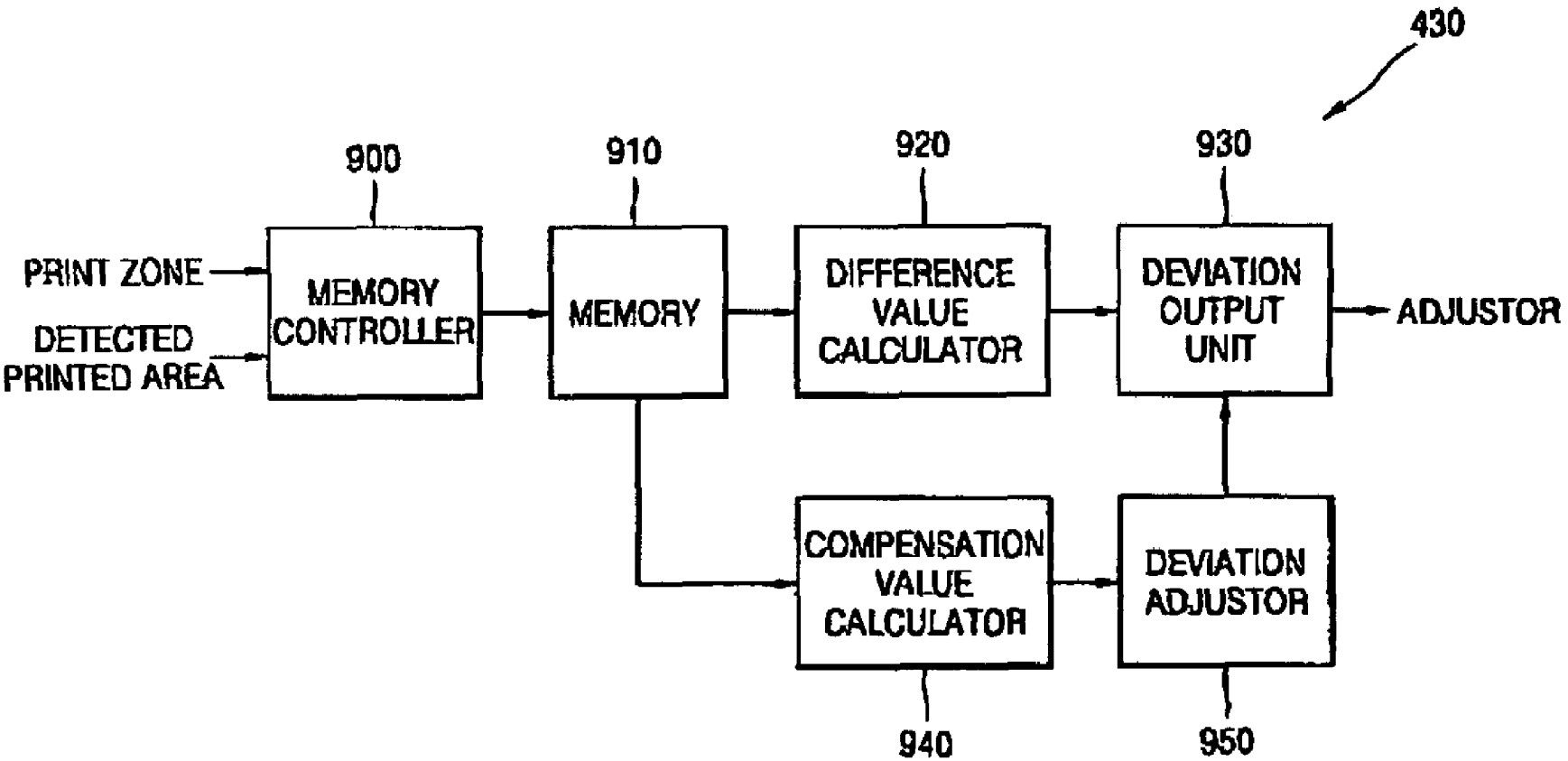
FIG. 9 is a detailed block diagram showing an embodiment of a deviation calculator depicted in FIG. 4.
Figure 14:
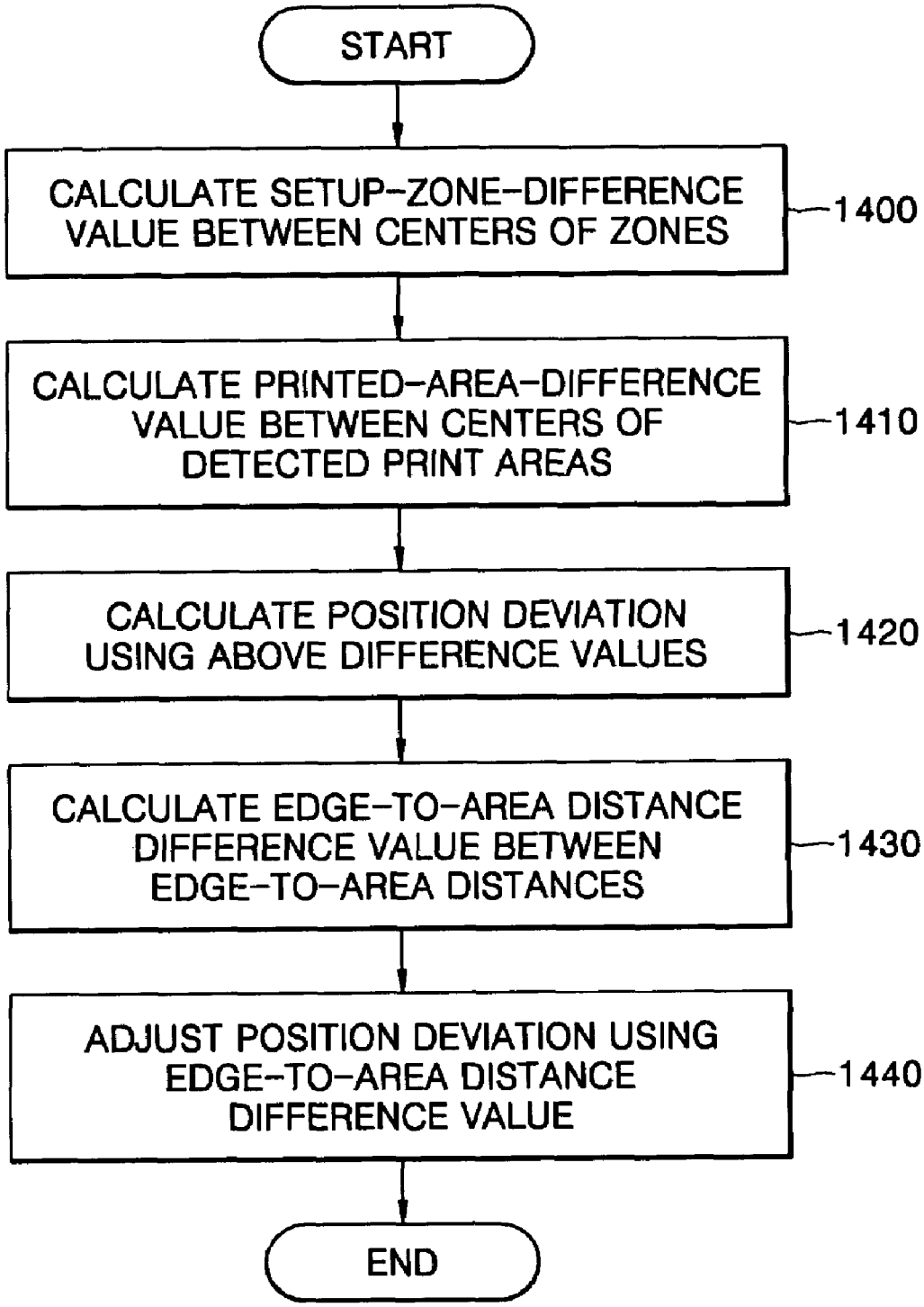
FIG. 14 is a detailed flow chart showing an embodiment of a position deviation calculating operation depicted in FIG. 11.

FIG. 9 is a detailed block diagram showing an embodiment of a deviation calculator depicted in FIG. 4, and FIG. 14 is a detailed flow chart showing an embodiment of a position deviation calculating operation depicted in FIG. 11.

Referring to FIGS. 9 and 14, the deviation calculator 430 comprises a memory controller 900, a memory 910, a difference value calculator 920, a deviation output unit 930, a compensation value calculator 940, and a deviation adjustor 950. An operation of the deviation calculator 430 will be now described with reference to FIG. 14.

The memory controller 900 controls the memory 910 to store the first and second setup print zones on which the first and second patterns to be printed respectively. Also, the memory controller 900 controls the memory 910 to store the detected first print area that have been detected by the area detector 420 after the first pattern is printed on the medium 410. Also, the memory controller 900 controls the memory 910 to store the detected first-to-second print area that have been detected by the area detector 420 after the first and the second patterns are printed on the medium 410.

In operation 1400, the difference value calculator 920 calculates a first central position from the first setup print zone stored in the memory 910, a second central position from the first and second setup print zones stored in the memory 910, and a setup-zone-difference value between the first central position and the second central position.

In operation 1410, the difference value calculator 920 calculates a first central position from the detected first printed area stored in the memory 910, a second central position from the detected first-to-second printed area, and a printed-area-difference value between the first central position and the second central position. Herein, the detected first printed area is an actually printed area of the first pattern, and the detected first-to-second printed area is an actually printed area of the first and second patterns.

In operation 1420, the deviation output unit 930 compares the setup-zone-difference value calculated in operation 1400 with the printed-area-difference value calculated in operation 1410 in order to calculate a position deviation between the printed areas of the first and second sides of the medium 410. An edge-detecting position error, which occurs between the rising and falling edges of the image data because of the property of the sensor 600, can be reduced by using the central positions of the setup print zones and the printed areas.

In operation 1430, the compensation value calculator 940 calculates an edge-to-area distance difference value between a first edge-to-area distance and a second edge-to-area distance. Herein, the first edge-to-area distance denotes the distance between the edge of the medium 410 and the detected first printed area, and the second edge-to-area distance denotes the distance between the edge of the medium 410 and the detected first-to-second printed area. In operation 1440, the deviation adjustor 950 uses the edge-to-area distance difference value calculated in operation 1430 to adjust the position deviation calculated in operation 1420. Through operation 1440, an error resulted from a surface gap between the sensor 600 and the medium 410 can be compensated.

Figure 10:
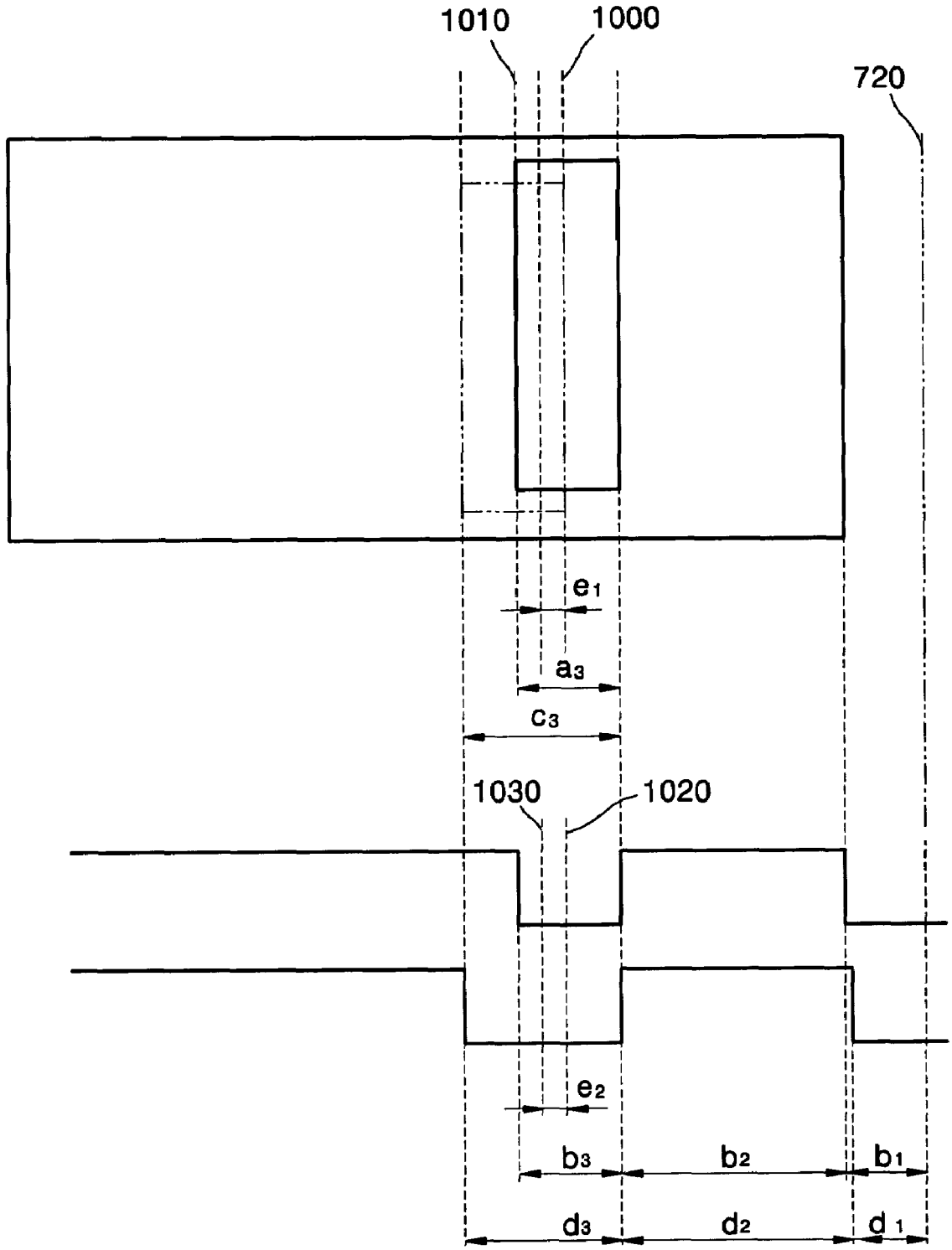
FIG. 10 is a view showing an embodiment of a method of calculating a position deviation between printed areas of first and second sides of a medium.

FIG. 10 shows an embodiment of a method of calculating a position deviation between a first printed area and a second printed area of a medium. Upper view shows an embodiment of setup print zones of first and second patterns, and lower view shows image data obtained by sensing first and second patterns printed on a medium.

Referring to FIG. 10, the first and second setup print zones have the same length (a3) and are overlapped each other by the half-length of them. A length (e1) denotes a setup-zone-difference value between a centerline 1000 of a first setup print zone and a centerline 1010 of first and second setup print zones. A length (e2) denotes a printed-area-difference value between a centerline 1020 of a first printed area and a centerline 1030 of a first-to-second printed area. A difference (e2−e1) denotes a position deviation between the setup-zone-difference and the printed-area-difference.

A length (b2) denotes a first edge-to-area distance from the edge of the medium 410 to the detected first printed area, and a length (d2) denotes a second edge-to-area distance from the edge of the medium 410 to the detected first-to-second printed area. To compensate for an error resulting from the surface gap between the sensor 600 and the medium 410 while the first and second side of the medium 410 is printed, the position deviation (e2−e1) may be adjusted by adding the edge-to-area distance difference value (d2−b2).

Figure 15:
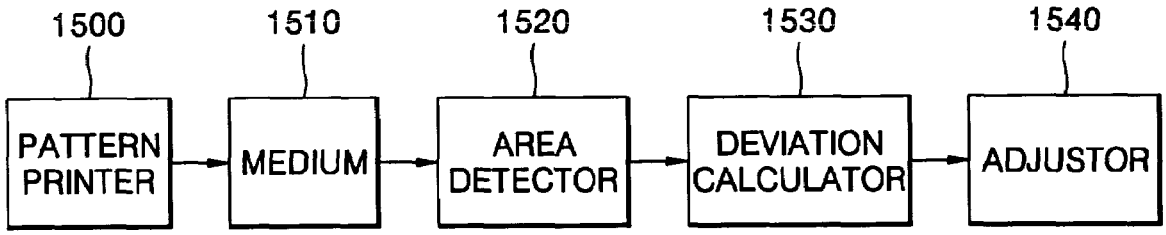
FIG. 15 is a block diagram showing a construction of an alignment adjustment device according to another embodiment of the present invention.
Figure 22:
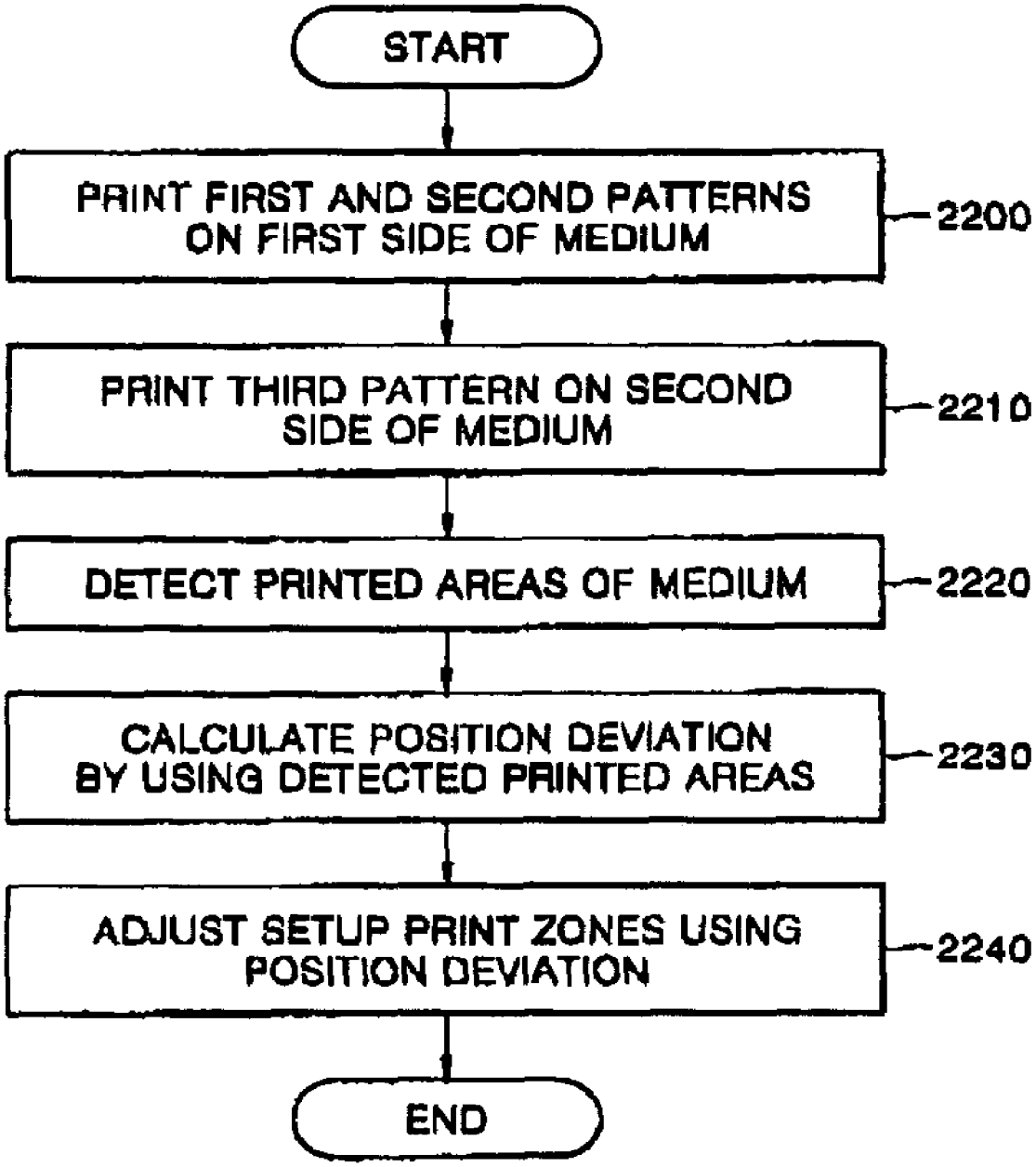
FIG. 22 is a flow chart showing a method of adjusting an image alignment according to another embodiment of the present invention.

FIG. 15 is a block diagram showing a construction of an alignment adjustment device according to another embodiment of the present invention, and FIG. 22 is a flow chart showing a method of adjusting an image alignment according to another embodiment of the present invention.

Referring to FIGS. 15 and 22, an alignment adjustment device comprises a pattern printer 1500, an area detector 1520, a deviation calculator 1530, and an adjustor 1540. An operation of the alignment adjusting device will now be described with reference to FIG. 22.

In operation 2200, the pattern printer 1500 prints first and second patterns on a first side of a medium 1510. In operation 2210, the pattern printer 1500 prints a third pattern on a second side of the medium 1510. In operation 2220, the area detector 1520 detects printed areas of the first, second and third patterns on the medium 1510 with a sensor.

In an embodiment of the present invention, the first, second, and third patterns may have rectangular shapes that can be easily detected. Also, the first, second, and third patterns may be set to be printed with a constant distance therebetween, such that a printed area deviation (position deviation) between printed areas of the first side and the second side of the medium 1510 can be easily calculated.

In operation 2230, the deviation calculator 1530 calculates the position deviation between the printed areas of the first side and second side of the medium 1510 by comparing the detected printed areas in operations 2220.

In operation 2240, the adjustor 1540 adjusts setup print zones of the first and second sides of the medium 1510 based on the calculated position deviation. For example, when the printed area of the first side of the medium 1510 precedes the printed area of the second side of the medium 1510 by 0.1 mm, a print starting point of the first side of the medium 1510 is adjusted by 0.1 mm in a back direction, or a print starting point of the second side of the medium 1510 is adjusted by 0.1 mm in a forward direction.

Figure 16:
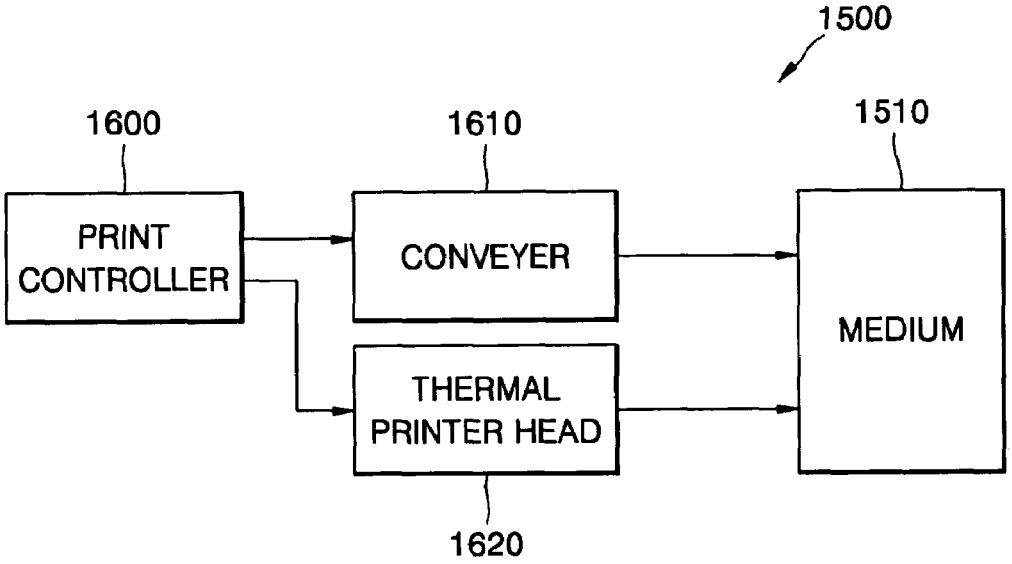
FIG. 16 is a detail block diagram showing an embodiment of a pattern printer depicted in FIG. 15 according to an embodiment of the present invention.
Figure 23:
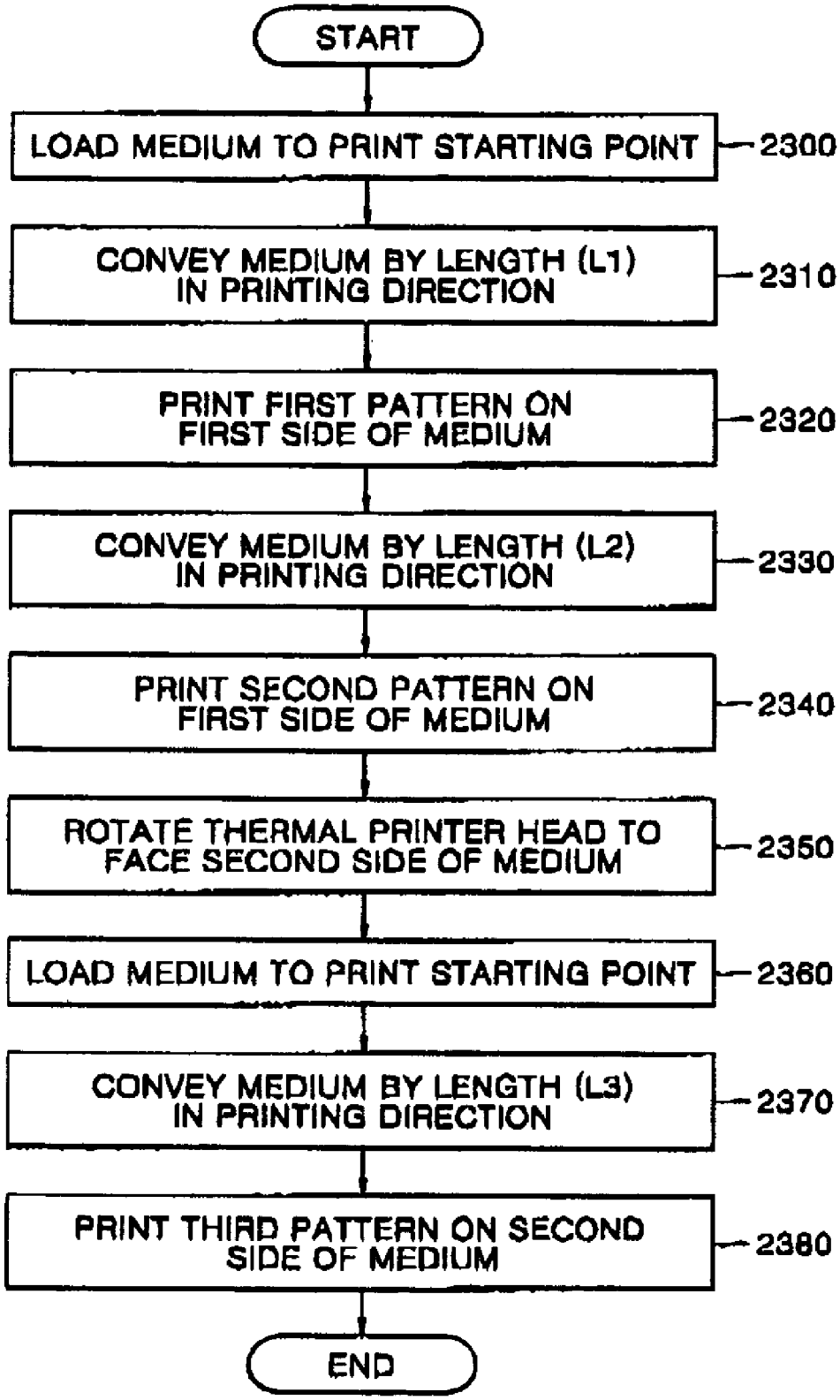
FIG. 23 is a detailed flow chart showing an embodiment of a pattern printing operation depicted in FIG. 22.

FIG. 16 is a block diagram showing an embodiment of a pattern printer depicted in FIG. 15, and FIG. 23 is a detailed flow chart showing an embodiment of a pattern printing operation depicted in FIG. 22.

Referring to FIGS. 16 and 23, the pattern printer 1500 comprises a print controller 1600, a conveyer 1610, and a thermal print head 1620. An operation of the pattern printer 1500 will be now described with reference to FIG. 23.

In operation 2300, the print controller 1600 controls the conveyer 1610 to load the medium 1510 in the back direction of the printing direction until the medium 1510 reaches a print starting point that has been set previously. In order to load the medium 1510 to the start point with the conveyer 1610, a sensor may be used to detect the edge of the medium 1510 when the medium 1510 arrives at the starting point.

In operation 2310, the print controller 1600 controls the conveyer 1610 to convey the medium 1510 in the printing direction by a predetermined length (L1) from the print starting point. Then, the thermal print head 1620 applies heat to the first side of the conveying medium 1510 to print a first pattern on the first side in operation 2320. After the printing of the first pattern, the medium 1510 is further conveyed in the printing direction by a predetermined length (L2) by the conveyer 1610 under the control of the print controller 1600 in operation 2330. Then, the thermal print head 1620 applies heat to the first side of the conveying medium 1510 to print a second pattern on the first side in operation 2340.

After completing the printing of the first and second patterns on the first side of the medium 1510, the thermal print head 1620 is rotated to face the second side of the medium 1510 in operation 2350. In operation 2360, the print controller 1600 controls the conveyer 1610 to convey the medium 1510 to the print starting point in the back direction of the printing direction.

In operation 2370, the print controller 1600 controls the conveyer 1610 to convey the medium 1510 in the printing direction by a predetermined length (L3) from the print starting point. Then, the thermal print head 1620 applies heat to the second side of the conveying medium 1510 to print a third pattern on the second side in operation 2380.

Figure 17:
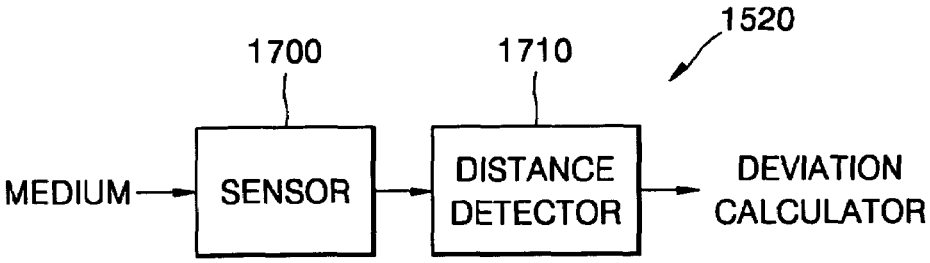
FIG. 17 is a detail block diagram showing an embodiment of an area detector depicted in FIG. 15.
Figure 24:
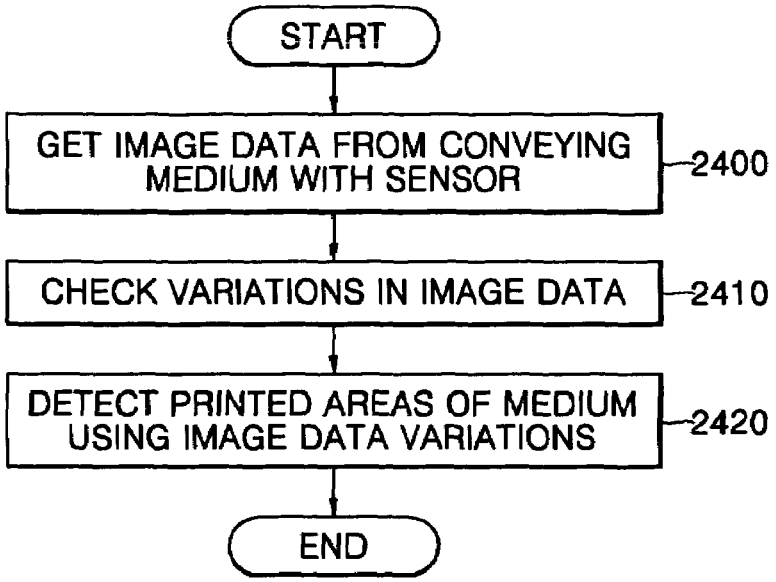
FIG. 24 is a flow chart showing an embodiment of a printed area detecting operation depicted in FIG. 22.

FIG. 17 is a block diagram showing an embodiment of an area detector depicted in FIG. 15, and FIG. 24 is a flow chart showing an embodiment of a printed area detecting operation depicted in FIG. 22.

Referring to FIGS. 17 and 24, the area detector 1520 comprises a sensor 1700 and a distance detector 1710. An operation of the area detector 1520 will be now described with reference to FIG. 24.

In operation 2400, when the medium 1510 is conveyed to the sensor 1700 by the conveyer 1610, the sensor 1700 senses the patterns printed on the medium 1510 and converts it into image data.

In operation 2410, the distance detector 1710 receives the image data from the sensor 1700 and detects variations in the image data. The distance detector 610 may detect rising edges or falling edges of the image data.

In operation 2420, the distance detector 1710 detects the position of printed areas on the medium 1510 by calculating the distances between the variations in the image data. An encoder (not shown) may be installed in the driving roller 335, the driven roller 340, or the platen roller 305 to generate an electrical signal in response to the rotation of the roller, and the distance detector 1710 may utilize the electrical signal to calculate the traveled distance of the medium 1510 between the detected variations in the image data.

Figure 18:
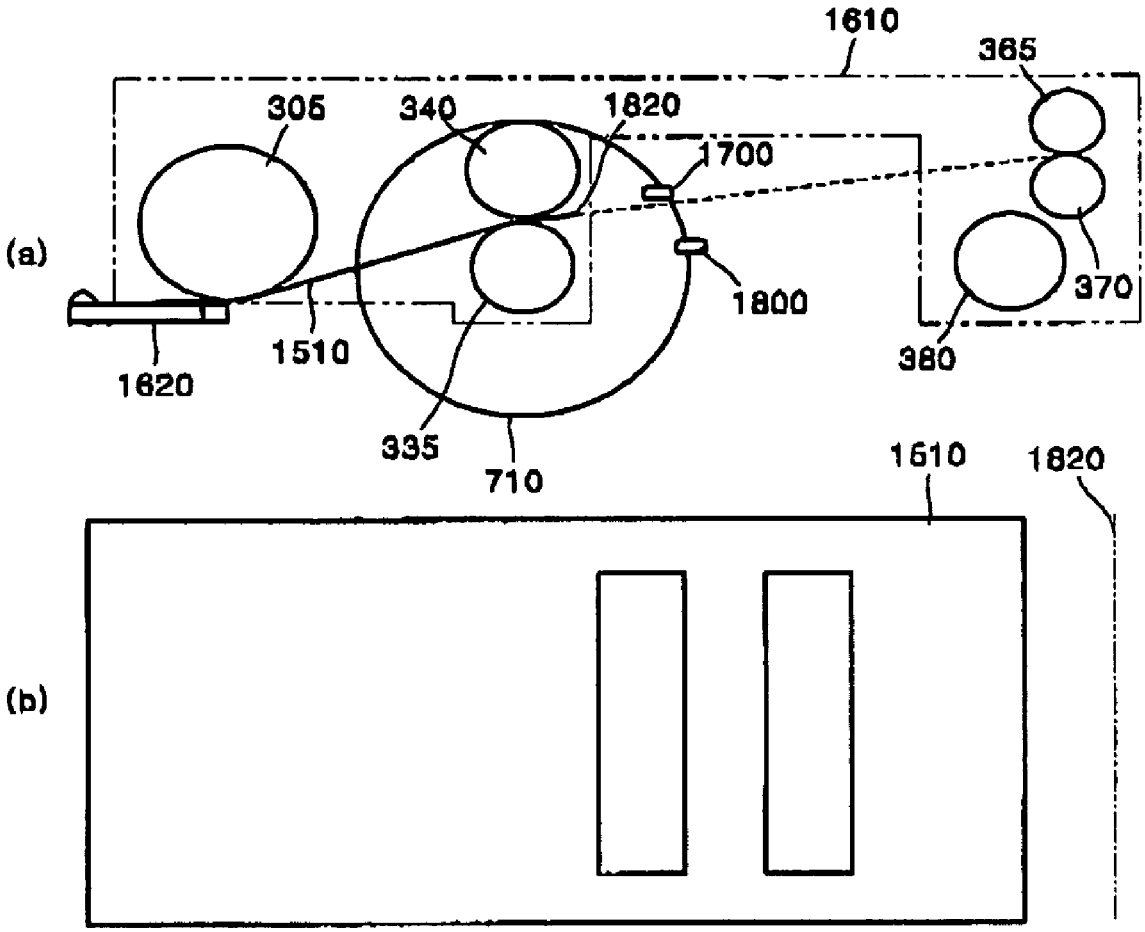
FIGS. 18A and 18B are views showing an embodiment of a method of printing a pattern on a first side of a medium.

FIGS. 18A and 18B are views showing an embodiment of a method of printing first and second patterns on a first side of a medium. FIG. 18A is a schematic view showing a construction of a printer, and FIG. 18B is a view showing an embodiment of first and second patterns printed on a first side of a medium.

Referring to FIG. 18A, the conveyer 1610 comprises the platen roller 305, the driving roller 335, the driven roller 340, the output driven roller 365, the output roller 370 and the pickup roller 380. The conveyer 1610 loads the medium 1510 to a print starting point 1820 until an edge-detecting sensor 1800 detects an edge of the medium 1510 and then first and second patterns are printed on the first side of the medium 1510 while the conveyer 1610 conveys the medium 1510 in a printing direction from the print starting point 1820.

Referring to FIG. 18B, the first and second patterns may be the same with a rectangular shape.

Figure 19:
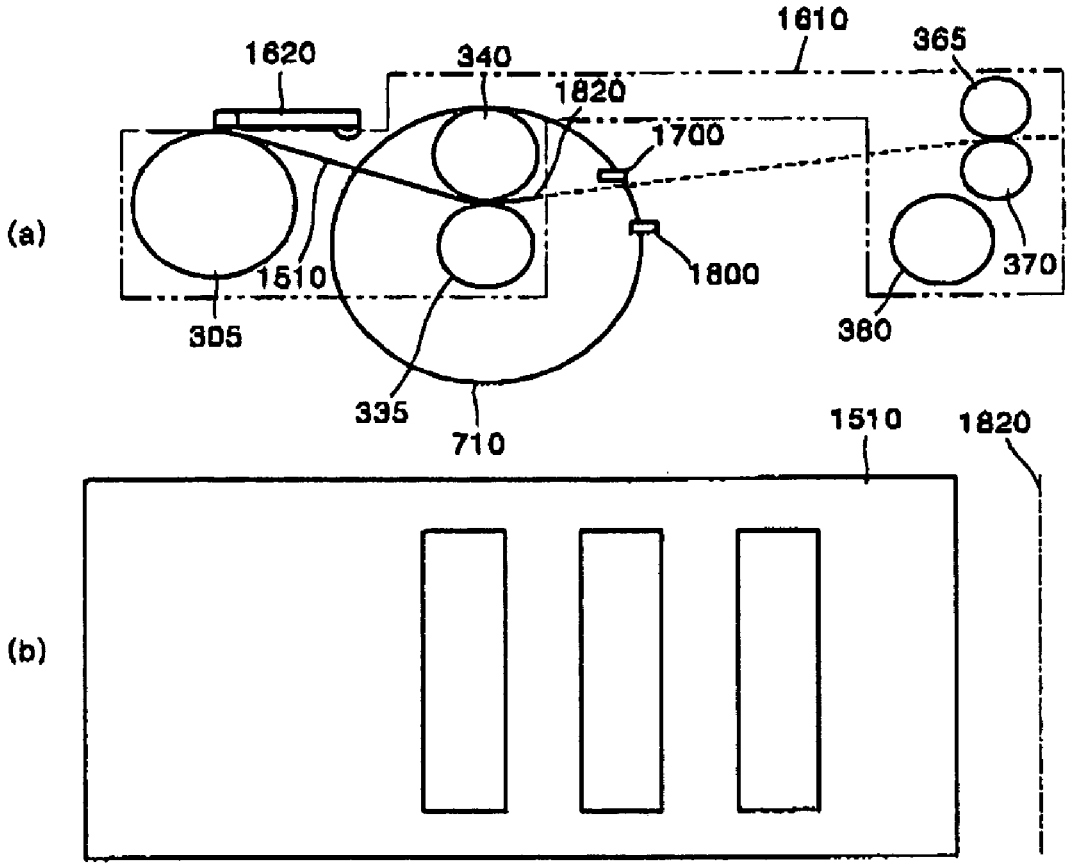
FIGS. 19A and 19B are views showing an embodiment of a method of printing a pattern on a second side of a medium.

FIGS. 19A and 19B are views showing an embodiment of a method of printing a third pattern on a second side of a medium. FIG. 19A is a schematic view showing a construction of a printer, and FIG. 19B is a view showing an embodiment of a third pattern printed on a second side of a medium.

Referring to FIG. 19A, the conveyer 1610 comprises the platen roller 305, the driving roller 335, the driven roller 340, the output driven roller 365, the output roller 370 and the pickup roller 380. The conveyer 1610 conveys the medium 1510 again to the print starting point 1820 after the first and second patterns are printed on the first side of the medium 1510. From the starting point 1820, the conveyer 1610 conveys the medium 1510 again in the printing direction to print a third pattern on the second side of the medium 1510.

Referring to FIG. 19B, the third pattern may have an exemplary rectangular shape like the first and second patterns. Also, the first, second, and third patterns are printed in such a manner that the distance between the first and second patterns may be equal to the distance between the second and third patterns.

Figure 20:
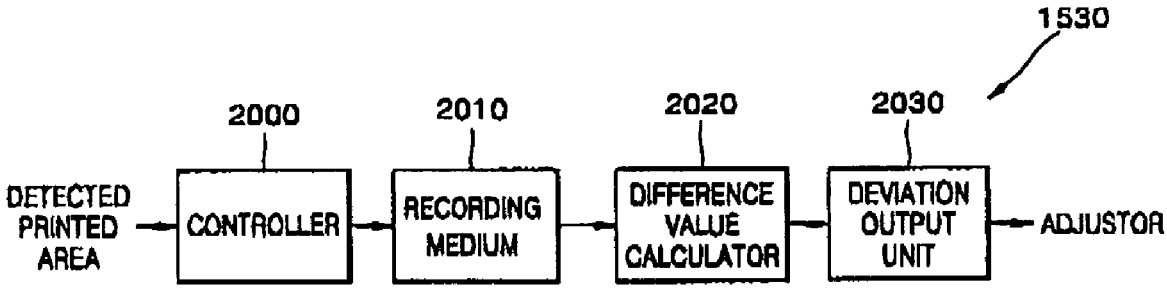
FIG. 20 is a detail block diagram showing an embodiment of a deviation calculator depicted in FIG. 15.
Figure 25:
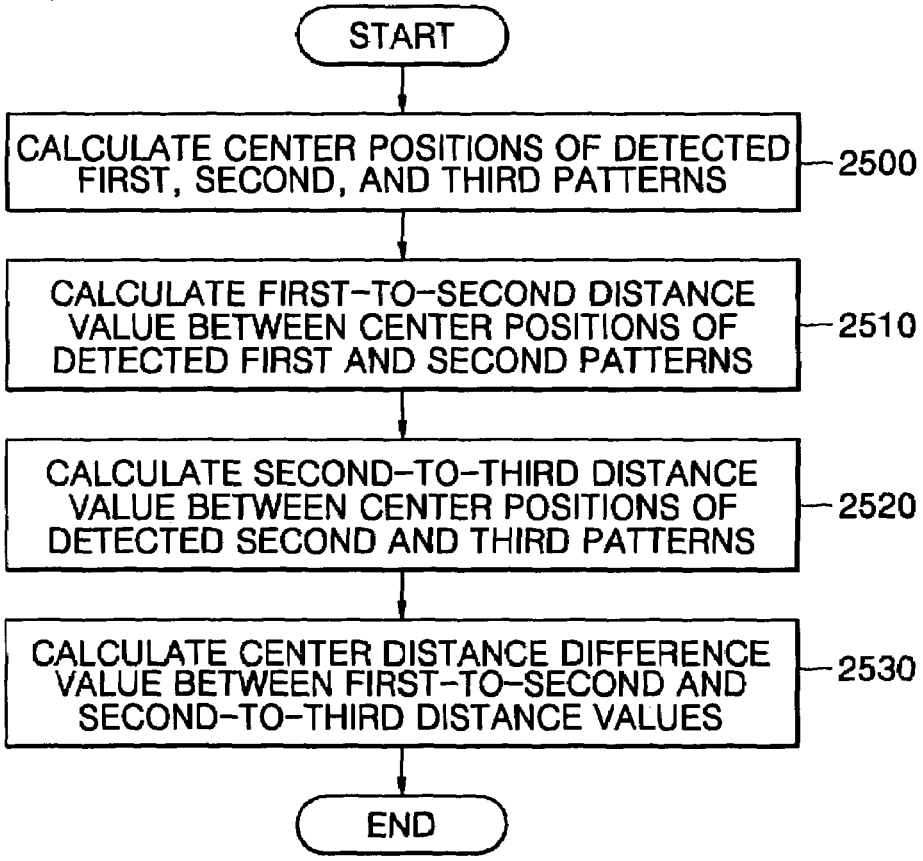
FIG. 25 is a flow chart showing an embodiment of a position deviation calculating operation depicted in FIG. 22.

FIG. 20 is a block diagram showing an embodiment of a deviation calculator depicted in FIG. 15, and FIG. 25 is a flow chart showing an embodiment of a position deviation calculating operation depicted in FIG. 22.

Referring to FIGS. 20 and 25, the deviation calculator 1530 comprises a controller 2000, a recording medium 2010, a difference value calculator 2020, and a deviation output unit 2030. An operation of the deviation calculator 1530 will be now described with reference to FIG. 25.

The controller 2000 controls the recording medium 2010 to store printed areas of the first, second, and third patterns that are detected by the area detector 1520.

In operation 2500, the difference value calculator 2020 reads the printed areas of the first, second, and third patterns from the recording medium 2010 and calculates center positions of the printed areas. In operation 2510, the difference value calculator 2020 calculates a first-to-second distance value between the center position of the first pattern printed area and the center position of the second pattern printed area. In operation 2520, the difference value calculator 2020 calculates a second-to-third distance value between the center positions of the second and third pattern printed areas.

In operation 2530, the deviation output unit 2030 calculates a difference value (center distance difference value) between the first-to-second distance value and the second-to-third distance value to obtain a position deviation between the printed areas of the first and second sides of the medium 1510, and then the deviation output unit 2030 outputs the position deviation. Since the position deviation is obtained using the first-to-second distance value and the second-to-third distance value, a sensor error between rising and falling edges of the image data output by the sensor 1700 can be reduced.

Figure 21:
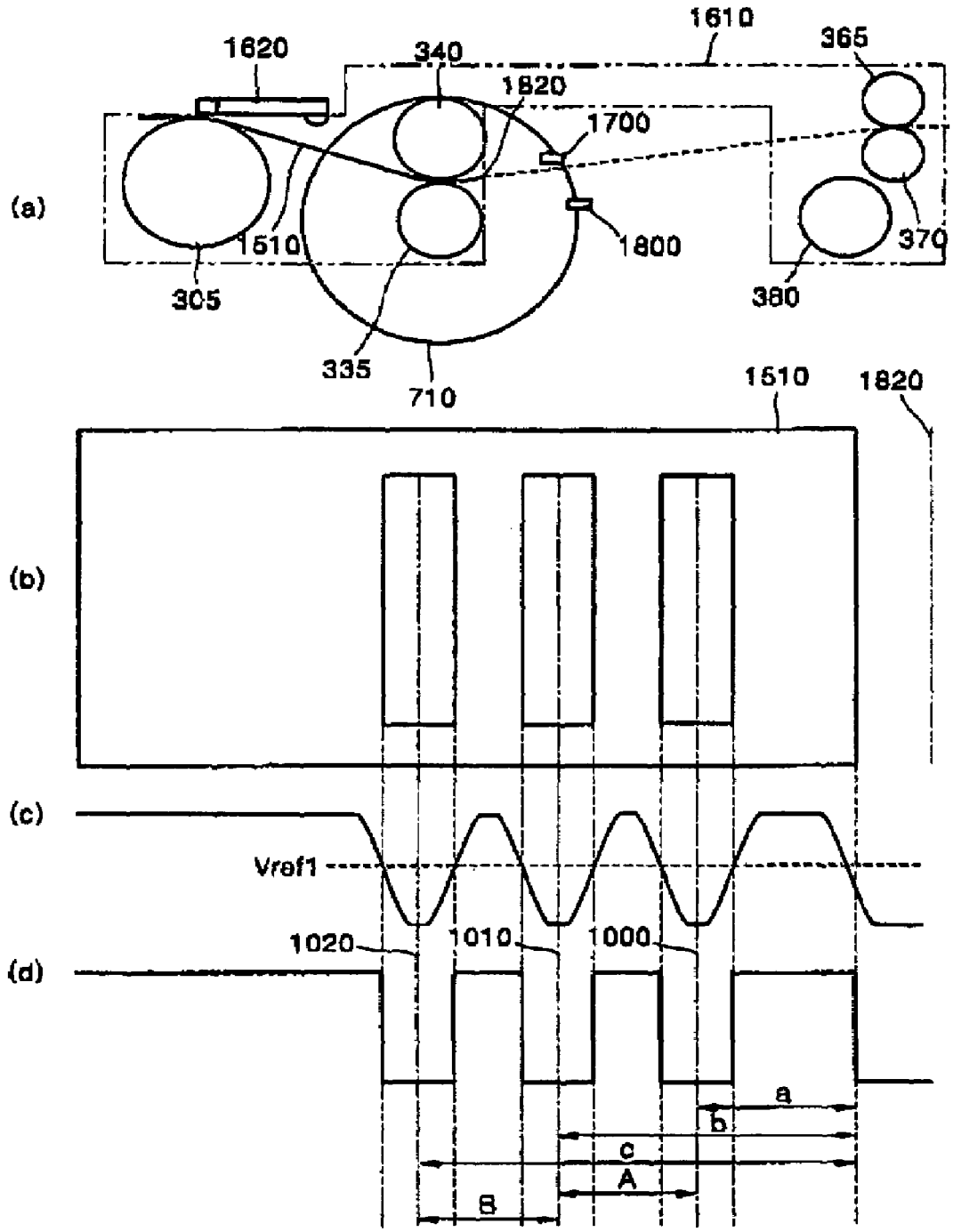
FIGS. 21A through 21D are views showing an embodiment of a method of calculating a position deviation between printed areas of first and second sides of a medium.

FIGS. 21A through 21D are views showing an embodiment of a method of calculating a position deviation between printed areas of first and second sides of a medium. FIG. 21A is a schematic view of a printer, in which the patterns are printed on the medium 1510 and the printed areas of the patterns are detected using the sensor 1700. The conveyor 1610 comprises the platen roller 305, the driving roller 335, the driven roller 340, the output driven roller 365, the output roller 370 and the pickup roller 380. FIG. 21B is a view showing an embodiment of first, second, and third patterns printed on the first and second sides of the medium 1510. Referring to FIG. 21B, the first, second, and third patterns have same-sized rectangular shapes. Also, the distance between the first and second patterns is equal to the distance between the second and third patterns.

FIG. 21C shows an analog output signal of the sensor 1700 in response to the first, second, and third patterns printed on the medium 1510. FIG. 21D shows a digital output signal of the sensor 1700 corresponding to the analog output signal depicted in FIG. 21C. Each time the analog output signal is equal to a digital reference value "Vrref1", rising or falling edge is presented in the digital output signal.

Referring to FIG. 21A through 21D, a length (a) denotes the distance between an edge of the medium 1510 and a center line (position) 1000 of the first pattern printed area, a length (b) denotes the distance between the edge of the medium 1510 and a center line (position) 1010 of the second pattern printed area, and a length (c) denotes the distance between the edge of the medium 1510 and a center line (position) 1020 of the third pattern printed area. A first-to-second distance value (A) can be obtained by subtracting the length (a) from the length (b), and a second-to-third distance value (B) can be obtained by subtracting the length (b) from the length (c).

Since the first, second, and third patterns are set to be spaced side by side at the same distance, the sameness of the two distance values (A) and (B) indicates that there is no position deviation between the printed areas of the first side and second side of the medium 1510. Therefore, the position deviation can be obtained by calculating a difference value (center distance difference value) between the first-to-second distance value and the second-to-third distance value.

Figure 26:
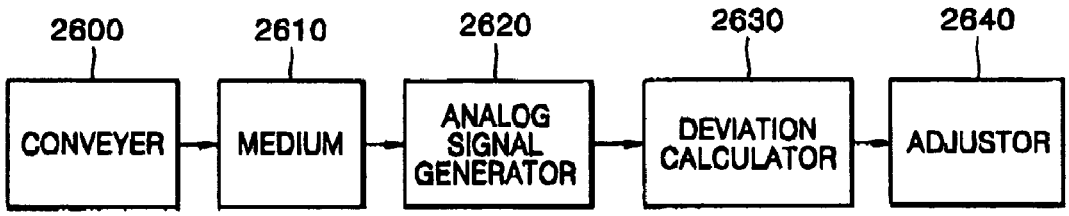
FIG. 26 is a block diagram showing a construction of an alignment adjustment device according to another embodiment of the present invention.
Figure 34:
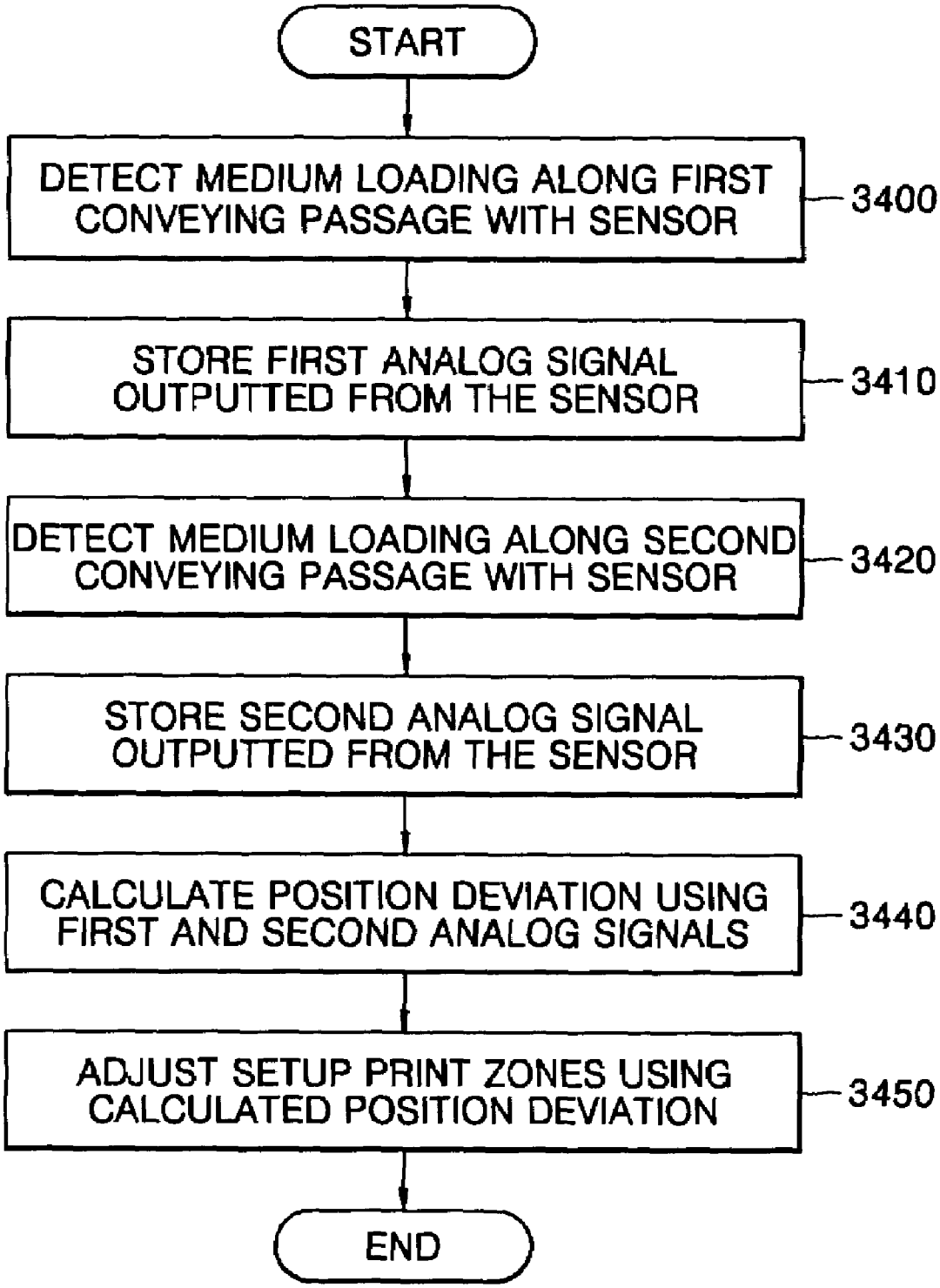
FIG. 34 is a flow chart showing a method of adjusting an image alignment according to another embodiment of the present invention.

FIG. 26 is a block diagram showing a construction of an alignment adjustment device according to a further another embodiment of the present invention, and FIG. 34 is a flow chart showing a method of adjusting an image alignment according to another embodiment of the present invention.

Referring to FIGS. 26 and 34, an alignment adjusting device comprises a conveyer 2600, an analog signal generator 2620, a deviation calculator 2630, and a deviation adjustor 2640. An operation of the alignment adjusting device will be now described with reference to FIG. 34.

In operation 3400, the conveyer 2600 loads a medium 2610 along a first conveying passage, and the analog signal generator 2620 detects the loading of the medium 2610. In operation 3410, the analog signal generator stores a first analog signal that is generated by a sensor in response to the loading of the medium 2610.

In operation 3420, the conveyer 2600 loads the medium 2610 along a second conveying passage, and the analog signal generator 2620 detects the loading of the medium 2610. In operation 3430, the analog signal generator 2620 stores a second analog signal that is generated by the sensor in response to the loading of the medium 2610.

In operation 3440, the deviation calculator 2630 calculates a position deviation between printed areas of first side and second side of the medium 2610 by using the first and second analog signals. Since the distance between the medium 2610 and the sensor, used for placing the medium 2610 at a print starting point, varies depending on the loading passages (the first and second conveying passages) of the medium 2610, the print starting points of the first side and second side of the medium 2610 are not coincident, causing the position deviation between the printed areas of first and second sides of the medium 2610.

In operation 3450, the adjustor 2640 adjusts setup print zones of the first and second sides of the medium 2610. For example, when the printed first pattern on the first side of the medium 2610 precedes the printed second pattern on the second side of the medium 2610 by 0.1 mm, a print starting point of the first side of the medium 2610 is adjusted by 0.1 mm in a back direction, or a print staring point of the second side of the medium 2610 is adjusted by 0.1 mm in a forward direction.

Figure 27:
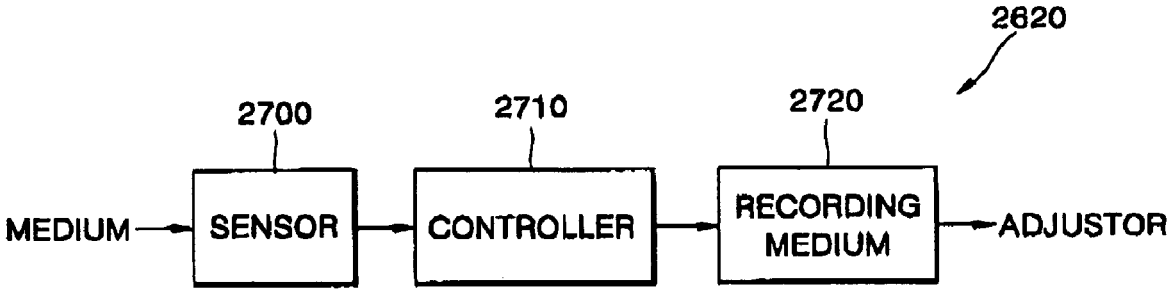
FIG. 27 is a block diagram showing an embodiment of an analog signal generator depicted in FIG. 26.

FIG. 27 is a block diagram showing an embodiment of an analog signal generator depicted in FIG. 26. Referring to FIG. 27, the analog signal generator 2620 comprises a sensor 2700, a controller 2710, and a recording medium 2720.

The sensor 2700 detects the medium 2610 when the medium 2610 is loaded along the first conveying passage and outputs the corresponding first analog signal. The controller 2710 stores the first analog signal in the recording medium 2720. The recording medium 2720 may comprise a Ring Queue Buffer (RQB) storing a predetermined portion of an analog signal centered on an edge of the analog signal.

Figure 28:
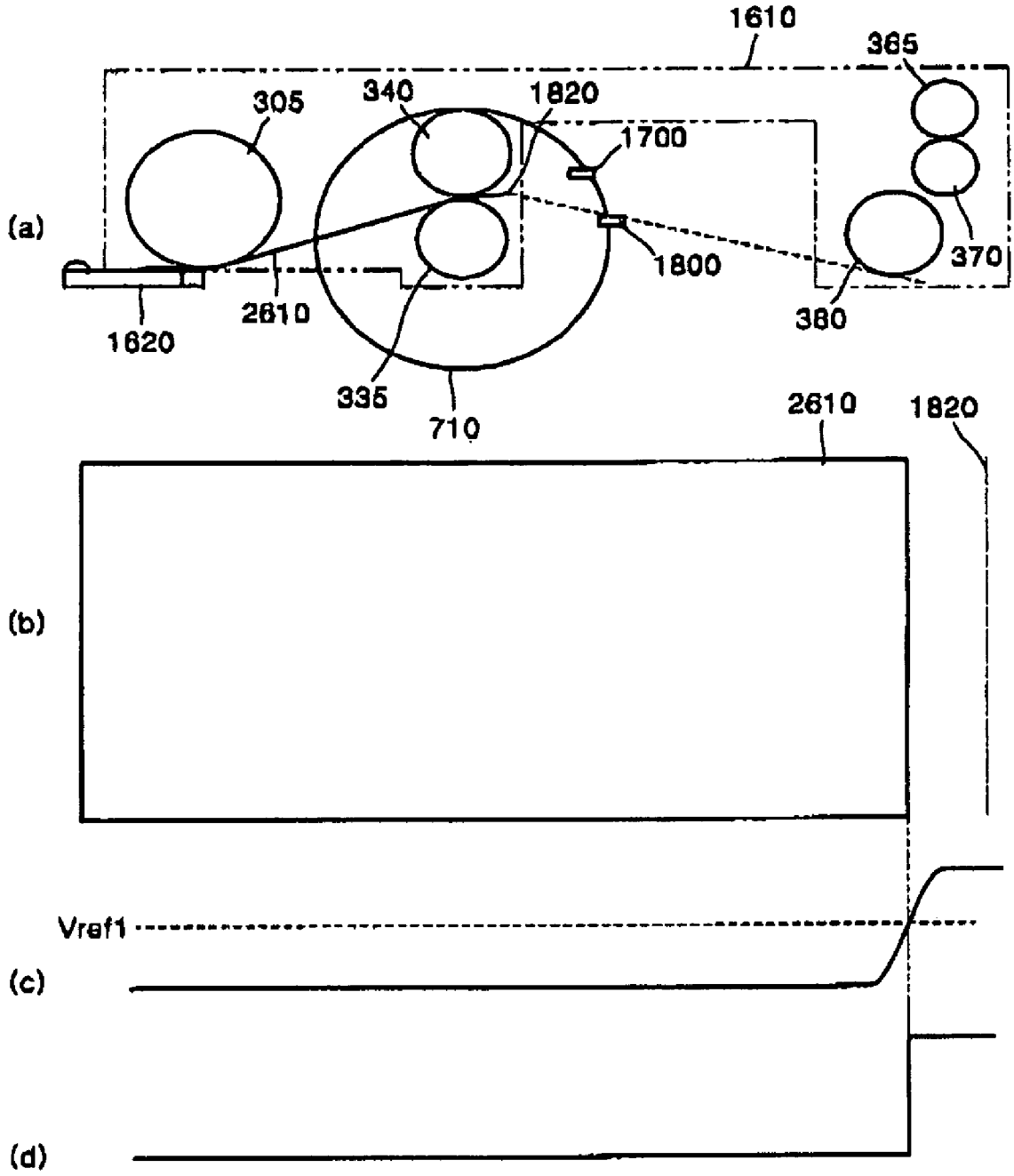
FIGS. 28A through 28D are views showing an embodiment of a method of detecting a medium with a sensor when the medium is loaded along a first conveying passage.

FIGS. 28A through 28D are views showing an embodiment of a method of detecting a medium with a sensor when the medium is loaded along a first conveying passage. FIG. 28A is a schematic view of a printer in which a first analog signal is generated by a sensor in response to a loading of a medium along a first conveying passage. In FIG. 28A, the conveyor 1610 comprises the platen roller 305, the driving roller 335, the driven roller 340, the output driven roller 365, the output roller 370 and the pickup roller 380. FIG. 28B shows a medium detected by an edge-detecting sensor. The medium 2610 is loaded to the first conveying passage by the driven roller 340 and the driving roller 335, and an edge-detecting sensor 1800 outputs a signal in response to the loading of the medium 2610.

The output signal of the edge-detecting sensor 1800 comprises an analog signal and a digital signal. FIG. 28C shows a first analog signal of the edge-detecting sensor 1800 in response to the loading of the medium 2610, and FIG. 28D shows a first digital signal of the edge-detecting sensor 1800 in response to the loading of the medium 2610. The medium 2610 is further conveyed a predetermined length from a location where an edge is presented in the first digital signal to place the medium at a print starting point 1820.

Figure 29:
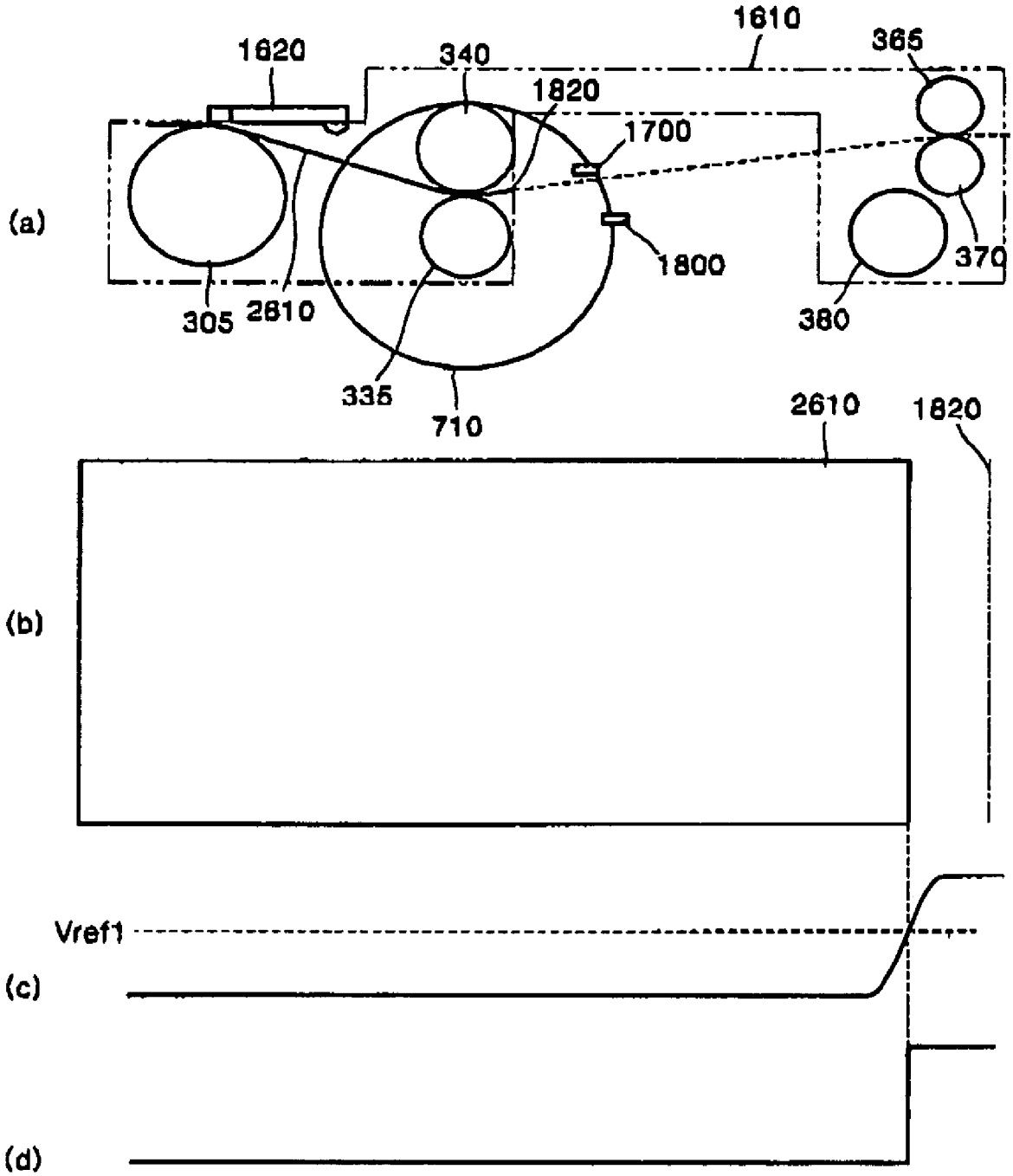
FIGS. 29A through 29D are views showing an embodiment of a method of detecting a medium with a sensor when the medium is loaded along a second conveying passage.

FIGS. 29A through 29D are views showing an embodiment of a method of detecting a medium with a sensor when the medium is loaded along a second conveying passage. FIG. 29A is a schematic view of a printer in which a second analog signal is generated by a sensor in response to a loading of a medium along a second conveying passage. In FIG. 28A, the conveyor 1610 comprises the platen roller 305, the driving roller 335, the driven roller 340, the output driven roller 365, the output roller 370 and the pickup roller 380. FIG. 28B shows a medium detected by an edge-detecting sensor. The medium 2610 is loaded to the second conveying passage by the driven roller 340 and the driving roller 335, and the edge-detecting sensor 1800 outputs a signal in response to the loading of the medium 2610.

FIG. 28C shows a second analog signal of the edge-detecting sensor 1800 in response to the loading of the medium 2610, and FIG. 28D shows a second digital signal of the edge-detecting sensor 1800 in response to the loading of the medium 2610.

Referring to FIGS. 28A and 29A, the distance between the medium 2610 and the edge-detecting sensor 1800 varies depending on the loading passages of the medium 2610, the first conveying passage and the second loading passage, resulting in a difference between the first and second analog signal of the edge-detecting sensor 1800. Therefore, the edge location of the first digital signal in FIG. 28D is not equal to the edge location of the second digital signal in FIG. 29D, such that the location of the print starting point 1820 varies depending on the side of the medium 2610.

Figure 30:
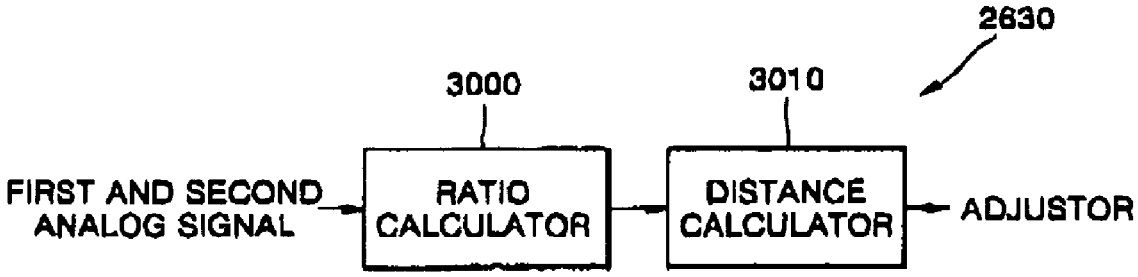
FIG. 30 is a block diagram showing an embodiment of a deviation calculator depicted in FIG. 26.
Figure 35:
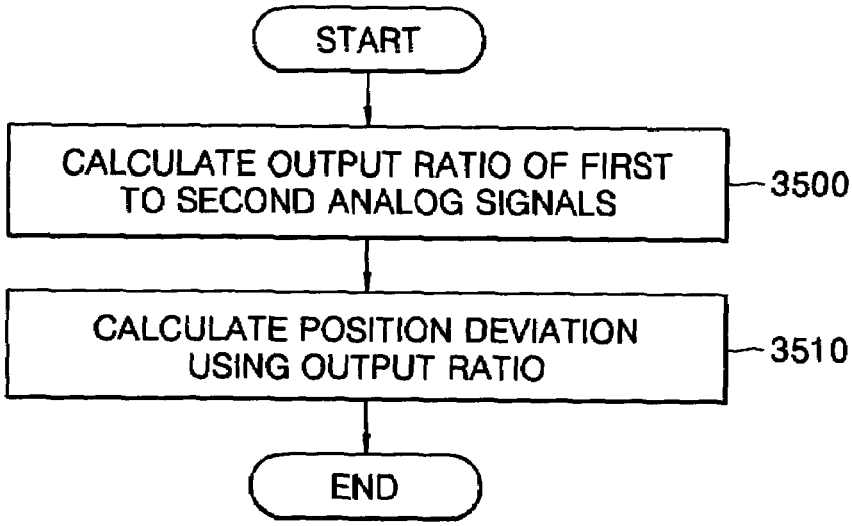
FIG. 35 is a flow chart showing an embodiment of a position deviation calculating operation depicted in FIG. 34.

FIG. 30 is a block diagram showing an embodiment of a deviation calculator depicted in FIG. 26, and FIG. 35 is a flow chart showing an embodiment of a position deviation calculating operation depicted in FIG. 34.

Referring to FIGS. 30 and 35, the deviation calculator 2630 comprises a ratio calculator 3000 and a distance calculator 3010. An operation of the deviation calculator 2630 will be described with reference to FIG. 35.

Figure 31:
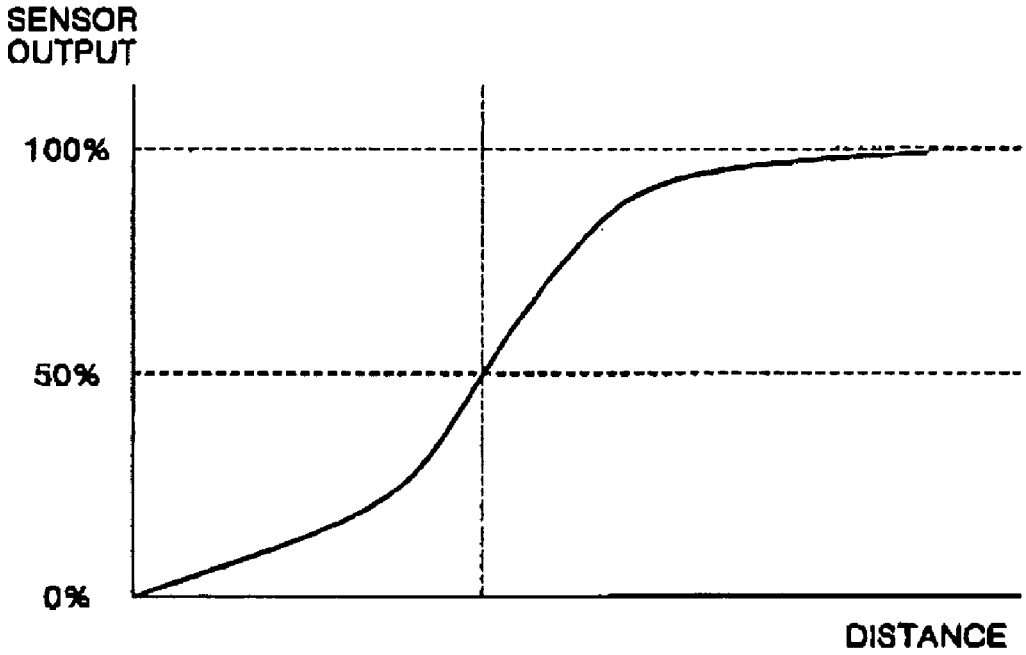
FIG. 31 is a graph showing an output signal of a sensor when a medium edge is sensed according to an embodiment of the present invention.

In operation 3500, the ratio calculator 3000 receives the first and second analog signal generated from the analog signal generator 2620 and calculates an output ratio of the first analog signal to the second analog signal. FIG. 31 shows an exemplary analog signal of a sensor in response to the loading of a medium. Referring to FIG. 31, the illustrated shape of the analog signal of the sensor is not affected by the distance between the medium and the sensor. Therefore, the output ratio of the first signal to second signal does not change according to the variation in the distance between the medium and the sensor. Maximum points of the first and second analog signals may be used to obtain the output ratio. Also, a point located a predetermined distance from the edge of the digital signal may be defined as the maximum point of the analog signal.

In operation 3510, the distance calculator 3010 calculates the distance between the edges of the first and second digital signals by using the output ratio of the first analog signal to second analog signal. Herein, the distance calculated in operation 3510 is the position deviation of the printed areas of the first and second sides of the medium.

Figure 32:
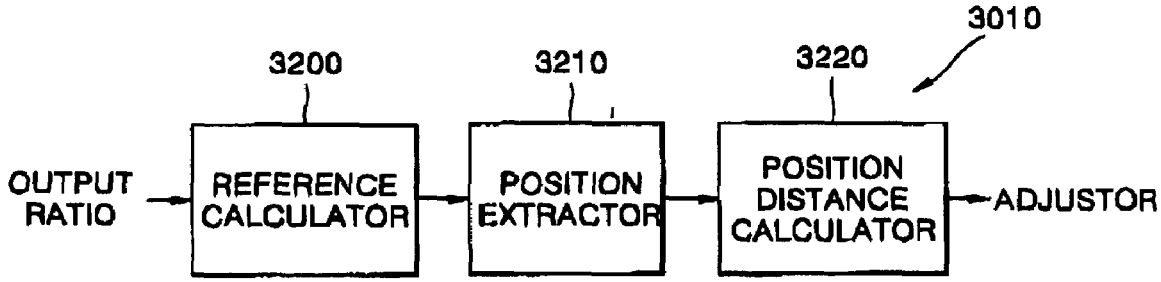
FIG. 32 is a block diagram showing an embodiment of a distance calculator depicted in FIG. 30.
Figure 33:
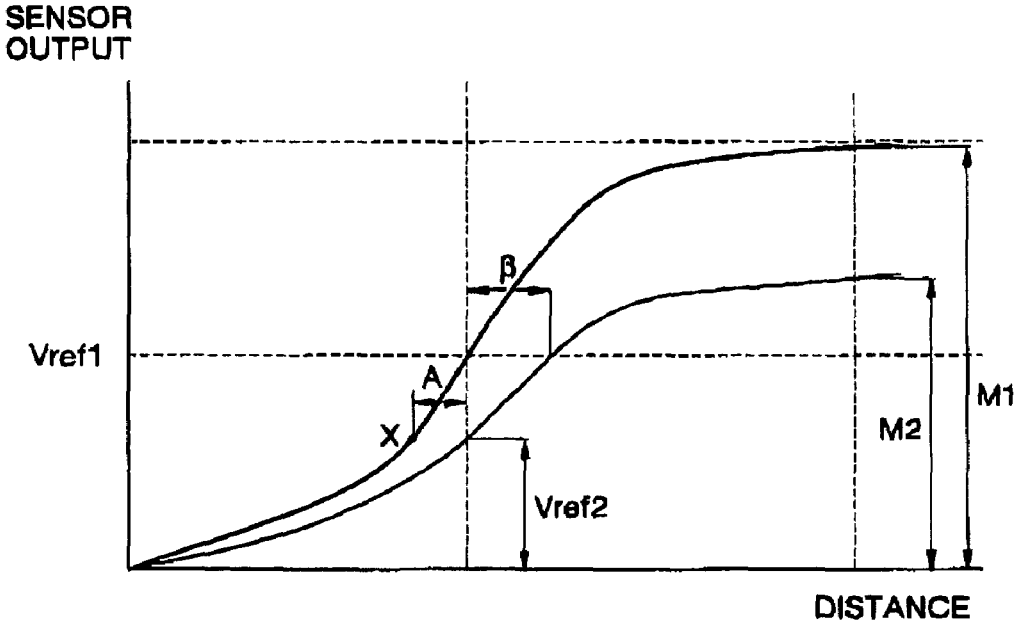
FIG. 33 is a graph showing a method of calculating a position deviation by using analog signals of a sensor according to an embodiment of the present invention.
Figure 36:
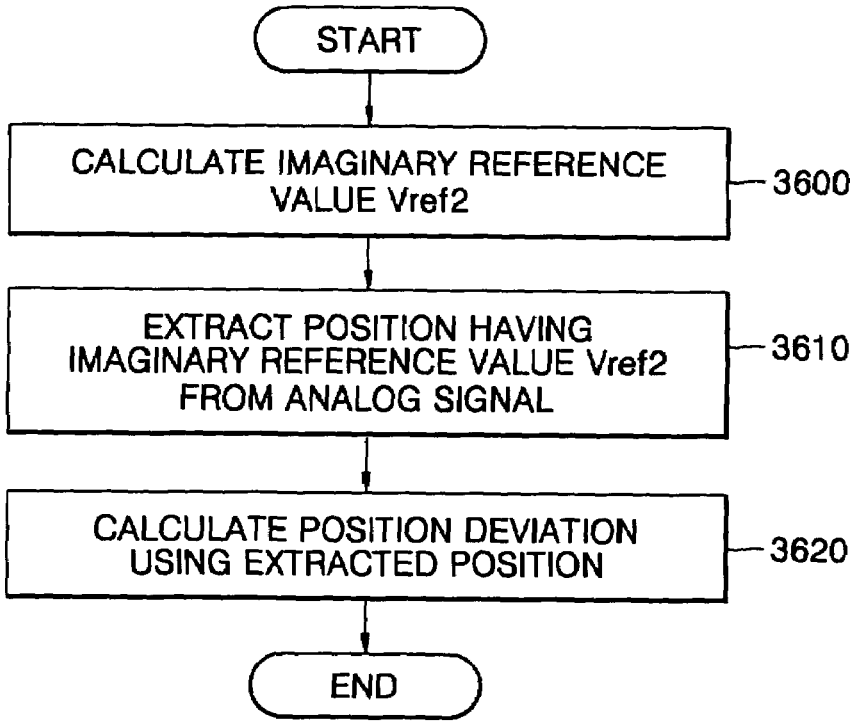
FIG. 36 is a flow chart showing an embodiment of a position deviation calculating operation depicted in FIG. 34, the position deviation calculating operation utilizing an output ratio.

FIG. 32 is a block diagram showing an embodiment of a distance calculator depicted in FIG. 30, FIG. 33 is a graph showing a method of calculating a position deviation by using analog signals of a sensor according to the present invention, and FIG. 36 is a detail flow chart showing an embodiment of a position deviation calculating operation depicted in FIG. 34.

Referring to FIGS. 32, 33, and 36, the distance calculator 3010 comprises a reference calculator 3200, a position extractor 3210, and a position distance calculator 3220. An operation of the distance calculator will now be described with reference to FIGS. 33 and 36.

In operation 3600, the reference calculator 3200 receives an output ratio of the first to second analog signals (M1:M2) from the ratio calculator 3000 to calculate an imaginary reference value Vref2 using Equation 1 below:

$$Vref1:Vref2=M1:M2, \quad \text{Equation 1}$$

where Vref1 is a digital reference value denoting a point of the analog signal where the edge is presented in the digital signal. The digital reference value Vref1 is previously set in the sensor.

In operation 3610, the position extractor 3210 extracts a first position having the imaginary reference value Vref2 from the first analog signal.

In operation 3620, the position distance calculator 3220 calculates a position deviation between the printed areas of the first and second sides of the medium by using a position distance between the first position and a second position having the imaginary reference value Vref2 in the second analog signal.

In detail (refer to FIG. 33), the position distance calculator 3220 calculates a position distance (A) between the first and second positions having the same value as the imaginary reference value Vref1 in the first and second analog signals. Since a length β between points having the same value as the digital reference value Vref1 in the first and second analog signals is corresponding to the distance between the edges of the first and second digital signals, the position distance calculator 3220 takes the calculated position distance (A) as an approximate value of the length β or calculates the length β0 with Equation 2 below to obtain the position deviation between the printed areas of the first and second sides of the medium.

$$Vref2:Vref1=A:\beta \quad \text{Equation 2}$$

As described above, the position deviation of printed areas on the first and second sides of the medium is calculated by comparing the setup print zones of patterns on the first and second sides with the printed areas detected by the sensor. The setup print zones are adjusted with the calculated position deviation, such that the alignment between the printed areas of the first and second sides can be adjusted in an exact and convenient way. Also, center positions of the setup print zones and the printed areas are used to calculate the position deviation, such that the errors resulting from the property of the sensor and the surface gap between the sensor and the medium can be compensated.

The invention can also be embodied as computer-readable codes on a computer-readable recording medium. The computer-readable recording medium is any data storage device that can store data which can be thereafter read by a computer system. Examples of the computer-readable recording medium comprise read-only memory (ROM), random-access memory (RAM), CD-ROMs, magnetic tapes, floppy disks, optical data storage devices, and carrier waves (such as data transmission through the Internet). The computer-readable recording medium can also be distributed over network coupled computer systems so that the computer-readable code is stored and executed in a distributed fashion. Also, functional programs, codes, and code segments for accomplishing the present invention can be easily construed by programmers skilled in the art to which the present invention pertains.

While this invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A method of adjusting an image alignment of an image forming apparatus provided with a thermal print head for applying heat to first and second sides of a medium for printing, the method comprising:

detecting a first printed area on the first side of the medium with a sensor after printing a first pattern on a first setup print zone of the first side of the medium;

detecting a first-to-second printed area of the medium with the sensor after printing a second pattern on a second setup print zone of the second side of the medium;

calculating a position deviation between the printed areas of the first side and the second side, by using the first setup print zone, the second setup print zone, the detected first printed area, and the detected first-to-second printed area; and adjusting print positions of the first or the second sides of the medium by using the calculated position deviation.

2. The method of claim 1, wherein each detecting operation comprises:

receiving image data of the medium from the sensor;

determining a variation in the image data; and detecting the printed area by using the determined variation of the image data.

3. The method of claim 2, wherein the variation in the image data is a rising edge or a falling edge of the image data.

4. The method of claim 1, wherein the step of adjusting print positions is performed by adjusting a first heating start point from which the thermal print head starts to apply heat to the first side of the medium or adjusting a second heating start point from which the thermal print head starts to apply heat to the second side of the medium.

5. A computer-readable recording medium having a computer-readable program for executing the method of claim 1.

6. A method of adjusting an image alignment of an image forming apparatus provided with a thermal print head applying heat to first and second sides of a medium for printing, the method comprising:

detecting a first printed area on the first side of the medium with a sensor after printing a first pattern on a first setup print zone of the first side of the medium;

detecting a first-to-second printed area on the medium with a sensor after printing a second pattern on a second setup print zone of the second side of the medium, the second setup print zone being overlapped with the first setup print zone on the first side of the medium;

calculating a position deviation between the printed areas of the first side and the second side by using the first setup print zone, the second setup print zone, the detected first printed area, and the detected first-to-second printed area; and adjusting print positions of the first or the second sides of the medium by using the calculated position deviation.

7. The method of claim 6, wherein the thermal print head is rotated to face the first side and the second side of the medium.

8. The method of claim 6, wherein each of the patterns has a polygonal shape.

9. The method of claim 6, wherein each detecting operation comprises:

receiving image data of the medium from the sensor;

determining a variation in the image data; and detecting the printed area with the determined variation of the image data.

10. The method of claim 9, wherein the variation in the image data is a rising edge or a falling edge of the image data.

11. The method of claim 6, wherein the step of calculating the position deviation comprises:

calculating a setup-zone-difference value between a center of the first setup print zone and a center of the second setup print zone;

calculating a printed-area-difference value between a center of the detected first printed area and a center of the detected first-to-second printed area; and calculating the position deviation by using the calculated setup-zone-difference value and the printed-area-difference value.

12. The method of claim 11, further comprising:

calculating an edge-to-area distance difference value between a first edge-to-area distance and a second edge-to-area distance, wherein the first edge-to-area distance is a distance from an edge of the medium to the first printed area, the second edge-to-area distance is a distance from the edge of the medium to the first-to-second printed area, and the edge and the printed areas are detected in the detecting operations; and adjusting the position deviation by using the edge-to-area distance difference value.

13. The method of claim 6, wherein the step of adjusting print positions is performed by adjusting a first heating start point from which the thermal print head starts to apply heat to the first side of the medium or adjusting a second heating start point from which the thermal print head starts to apply heat to the second side of the medium.

14. A computer-readable recording medium having a computer-readable program for executing the method of claim 6.

15. An apparatus for adjusting an image alignment of an image forming apparatus provided with a thermal print head for applying heat to first and second sides of a medium for printing, the apparatus comprising:

a pattern printer for printing a first pattern on a first setup print zone of the first side of the medium and a second pattern on a second setup print zone of the second side of the medium;

an area detector detecting printed areas of the medium;

a deviation calculator for comparing the setup print zones with the printed areas detected by the area detector to calculate a position deviation between the printed areas of the first and the second sides of the medium; and an adjustor for adjusting print positions of the first or the second sides of the medium by using the calculated position deviation.

16. The apparatus of claim 15, wherein the pattern printer comprises:

a conveyer for conveying the medium;

a thermal print head for applying heat to the first side and the second side of the medium for a printing operation;

a print controller for controlling the conveyer and the thermal print head to print the first pattern on the first setup print zone of the first side of the medium and the second pattern on the second setup print zone of the second side of the medium.

17. The apparatus of claim 16, further comprising a head position adjustor for rotating the thermal print head to face the first side and the second side of the medium.

18. The apparatus of claim 15, wherein each of the patterns has a polygonal shape.

19. The apparatus of claim 15, wherein the area detector comprises:

a sensor sensing an image from the medium and outputting corresponding image data; and a distance detector checking variations in the image data to detect a distance between the variations.

20. The apparatus of claim 19, wherein the distance detector determines the variations in the image data and detects the distance between the variations by using an encoder.

21. The apparatus of claim 19, wherein the variations in the image data are rising edges or falling edges of the image data.

22. The apparatus of claim 15, wherein the deviation calculator comprises:

a memory for storing the setup print zones of the detected printed areas;

a memory controller for controlling the memory to store the first setup pint zone, the second setup print zone, a first printed area detected by the area detector after the first pattern is printed on the medium, and a first-to-second printed area detected by the area detector after the first and the second patterns are printed on the medium;

a difference value calculator for calculating a setup-zone-difference value between a center of the first setup print zone and a center of the second setup print zone, and a printed-area-difference value between a center of the detected first printed area and a center of the detected first-to-second printed area; and a deviation output unit for calculating the position deviation by using the calculated setup-zone-difference value and the printed-area-difference value.

23. The apparatus of claim 22, further comprising:

a compensation value calculator for calculating an edge-to-area distance difference value between a first area-to-edge distance and a second edge-to-area distance, wherein the first edge-to-area distance is a distance from an edge of the medium to the first printed area, the second edge-to-area distance is a distance from the edge of the medium to the first-to-second printed area; and a deviation adjustor for adjusting the position deviation calculated by the deviation output unit, by using the calculated edge-to-area distance difference value.

24. The apparatus of claim 15, wherein the adjustor uses the calculated position deviation to adjust a first heating start point from which the thermal print head starts to apply heat to the first side of the medium or adjust a second heating start point from which the thermal print head starts to apply heat to the second side of the medium.

25. A method of adjusting an image alignment of an image forming apparatus in which a thermal print head applies heat to a first side of a medium after loading the medium along a first conveying passage and applies heat to a second side of the medium after loading the medium along a second conveying passage, the method comprising:

detecting the medium with a sensor when the medium is loaded along the first conveying passage and storing a first analog signal output from the sensor in a recording medium;

detecting the medium with the sensor when the medium is loaded along the second conveying passage and storing a second analog signal output from the sensor in the recording medium;

calculating a position deviation between printed areas of the first side and the second side of the medium, by using the first and second analog signals stored in the recording medium; and adjusting print positions of the first or the second sides of the medium by using the calculated position deviation.

26. The method of claim 25, wherein the thermal print head is rotated to face the first side and the second side of the medium.

27. The method of claim 25, wherein each of the first and second analog signals is output by sensing a predetermined portion of the medium, the predetermined portion comprising an edge of the medium.

28. The method of claim 25, wherein the step of calculating the position deviation comprises:

calculating an output ratio of the first analog signal to the second analog signal; and calculating the position deviation with the calculated output ratio.

29. The method of claim 28, wherein the step of calculating the position deviation with the calculated output ratio comprises:

calculating an imaginary reference value by multiplying the calculated output ratio by a digital reference value of the sensor;

detecting a position having the imaginary reference value in the stored first analog signal; and calculating a position deviation between the detected position and a position having the digital reference value in the stored second analog signal.

30. The method of claim 28, wherein the step of calculating the position deviation with the calculated output ratio comprises:

obtaining an imaginary reference value by multiplying the calculated output ratio by a digital reference value of the sensor;

detecting a position having the imaginary reference value in the stored second analog signal; and calculating a position deviation between the detected position and a position having the digital reference value in the stored first analog signal.

31. The method of claim 25, wherein the step of adjusting the print position is performed by adjusting a first heating start point from which the thermal print head starts to apply heat to the first side of the medium or adjusting a second heating start point from which the thermal print head starts to apply heat to the second side of the medium.

32. A computer-readable recording medium having a computer-readable program for executing the method of claim 25.

33. A method of adjusting an image alignment of an image forming apparatus provided with a thermal print head applying heat to first and second sides of a medium for printing, the method comprising:

printing first and second patterns on first and second setup print zones of the first side of the medium, respectively;

after printing a third pattern on a third setup print zone of the second side of the medium, detecting printed areas of the first to third patterns with a sensor;

calculating a deviation between the printed positions of the first side and the second side, by using the detected printed areas; and adjusting print positions of the first or second sides of the medium by using the calculated deviation.

34. The method of claim 33, wherein the thermal print head is rotated to face the first side and the second side of the medium.

35. The method of claim 33, wherein the first, second, and third setup print zones are spaced the same distance from each other.

36. The method of claim 33, wherein the step of detecting the printed areas comprises:

receiving image data of the medium from the sensor;

determining variations in the image data; and detecting the printed areas on the medium with the determined variations of the image data.

37. The method of claim 36, wherein the variations in the image data are rising edges or falling edges of the image data.

38. The method of claim 33, wherein the step of calculating the position deviation comprises:

calculating a first-to-second distance value between centers of the detected first and second patterns;

calculating a second-to-third distance value between centers of the detected second and third patterns; and calculating a center distance difference value between the first-to-second difference value and the second-to-third difference value.

39. A computer-readable recording medium having a computer-readable program for executing the method of claim 33.

40. An apparatus for adjusting an image alignment of an image forming apparatus in which a thermal print head applies heat to a first side of a medium after loading the medium along a first conveying passage and applies heat to a second side of the medium after loading the medium along a second conveying passage to print on the first and second sides of the medium, the apparatus comprising:

a conveyer for loading the medium;

an analog signal generator for sensing the medium when the medium is conveyed along the first and second conveying passages to generate corresponding first and second analog signals;

a deviation calculator for calculating a deviation between printed positions of the first and second sides of the medium by using the first and second analog signals; and an adjustor for adjusting print positions of the first or the second sides of the medium by using the calculated position deviation.

41. The apparatus of claim 40, wherein the thermal print head is rotated to face the first side and the second side of the medium.

42. The apparatus of claim 40, wherein each of the first and second analog signals is output by sensing a predetermined portion of the medium, the predetermined portion comprising an edge of the medium.

43. The apparatus of claim 40, wherein the analog signal generator comprises:

a sensor for sensing the medium when the medium is loading along the first and second conveying passage to generate the corresponding first and second analog signals;

a recording medium for storing the first and second analog signals; and a controller for controlling the storing of the first and second analog signals in the recording medium.

44. The apparatus of claim 40, wherein the deviation calculator comprises:

a ratio calculator for calculating an output ratio of the first analog signal to the second analog signal; and a distance calculator for calculating the position deviation with the calculated output ratio.

45. The apparatus of claim 44, wherein the distance calculator comprises:

a reference calculator for calculating an imaginary reference value by multiplying the calculated output ratio by a digital reference value of the sensor;

a position detector for detecting a position having the imaginary reference value in the stored first analog signal; and a position distance calculator for calculating the position deviation by using the detected position and a position having the digital reference value in the stored second analog signal.

46. The apparatus of claim 44, wherein the distance calculator comprises:

a reference calculator for calculating an imaginary reference value by multiplying the calculated output ratio by a digital reference value of the sensor;

a position detector for detecting a position having the imaginary reference value in the stored second analog signal; and a position distance calculator for calculating the position deviation by using the detected position and a position having the digital reference value in the stored first analog signal.

47. An apparatus for adjusting an image alignment of an image forming apparatus provided with a thermal print head for applying heat to first and second sides of a medium for printing, the apparatus comprising:

a pattern printer for printing first and second patterns on the first side of the medium and a third pattern on the second side of the medium;

an area detector for detecting printed areas of the medium;

a deviation calculator for comparing the printed areas detected by the area detector to calculate a deviation between the printed positions of the first and the second sides of the medium; and an adjustor for adjusting print positions of the first or the second sides of the medium by using the calculated deviation.

48. The apparatus of claim 47, wherein the first, second, and third patterns are spaced the same distance from each other.

49. The apparatus of claim 47, wherein the pattern printer comprises:

a conveyer for conveying the medium;

a thermal print head for applying heat to the first side and the second side of the medium, for a printing operation;

a print controller for controlling the conveyer and the thermal print head to print the first and second patterns on first and second setup print zones of the first side of the medium and the third pattern on a third setup print zone of the second side of the medium.

50. The apparatus of claim 49, further comprising a head position adjustor for rotating the thermal print head to face the first side and the second side of the medium.

51. The apparatus of claim 47, wherein the area detector comprises:

a sensor for sensing an image on the medium and outputting corresponding image data; and a distance detector for determining variations in the image data to detect a distance between the variations.

52. The apparatus of claim 51, wherein the variations in the image data are rising edges or falling edges of the image data.

53. The apparatus of claim 47, wherein the deviation calculator comprises:

a memory for storing the detected printed areas;

a controller for controlling the recording medium to store printed areas detected by the area detector after the first, second, and third patterns are printed on the medium;

a difference value calculator for calculating a first-to-second distance value between centers of the detected first and second patterns and a second-to-third distance value between centers of the detected second and third patterns; and a deviation output unit for outputting a difference value between the first-to-second distance value and the second-to-third distance value.

* * * * *